US008833676B2

(12) United States Patent
Han

(10) Patent No.: US 8,833,676 B2
(45) Date of Patent: Sep. 16, 2014

(54) SPRAYING DEVICE

(76) Inventor: Tie fu Han, Fujian (CN)

( * ) Notice: Subject to any disclaimer, the term of this patent is extended or adjusted under 35 U.S.C. 154(b) by 912 days.

(21) Appl. No.: 12/737,494

(22) PCT Filed: Jul. 20, 2009

(86) PCT No.: PCT/CN2009/072841

§ 371 (c)(1),
(2), (4) Date: Jan. 18, 2011

(87) PCT Pub. No.: WO2010/006560

PCT Pub. Date: Jan. 21, 2010

(65) Prior Publication Data

US 2011/0121099 A1 May 26, 2011

(30) Foreign Application Priority Data

Jul. 18, 2008 (CN) ..... 2008 1 0071432
Mar. 9, 2009 (CN) ..... 2009 1 011270

(51) Int. Cl.

| | |
|---|---|
| ***B05B 3/04*** | (2006.01) |
| ***B05B 3/06*** | (2006.01) |
| ***A62C 31/05*** | (2006.01) |
| ***A62C 37/14*** | (2006.01) |
| ***B05B 7/04*** | (2006.01) |

(52) U.S. Cl.

CPC ..... *B05B 3/06* (2013.01); *B05B 3/0427* (2013.01); *A62C 31/05* (2013.01); *A62C 37/14* (2013.01); *B05B 7/0425* (2013.01)

USPC ..... 239/263; 239/240

(58) Field of Classification Search

CPC ..... B05B 13/0636; B05B 13/04; B05B 3/06; B05B 3/16

USPC ..... 239/263, 225.1, 230, 237, 240, 548, 239/559

See application file for complete search history.

(56) References Cited

U.S. PATENT DOCUMENTS

| | | | | |
|---|---|---|---|---|
| 3,120,346 A * | 2/1964 | Willhoite | ..... | 239/214.13 |
| 4,164,325 A * | 8/1979 | Watson | ..... | 239/252 |
| 5,452,853 A * | 9/1995 | Shook et al. | ..... | 239/7 |
| 5,626,674 A * | 5/1997 | VanKuiken et al. | ..... | 118/317 |

* cited by examiner

*Primary Examiner* — Davis Hwu

(74) *Attorney, Agent, or Firm* — Raymond Y. Chan; David and Raymond Patent Firm

(57) ABSTRACT

A rotary spray device includes a seat body having an entrance and a spray head body in which a fluid passage is provided. The rotary spray device further includes at least one impeller. The entrance communicates with the fluid passage by a fluid chamber. The impeller is located within the fluid chamber and is rotated with the spray head body. The spray head body is rotatably connected with the seat body. Preferably, the spray head body has eccentric spray nozzles, and the minimal distance is not zero between the center lines of the eccentric spray nozzles and the rotation center line of the spray head body, and the center lines do not parallel the rotation center line. The rotation center line of spray head body is an axis about which the spray head body rotates relative to the seat body. The spray device according to the present invention rotates the spray head body by the drive of the fluid energy, to perform a pressure pray, and may also spray leak liquid through the rotation clearance. It has a simple, compact structure, and may achieve a good effect.

13 Claims, 17 Drawing Sheets

SPRAYING DEVICE

CROSS REFERENCE OF RELATED APPLICATION

The present application claims the benefit of priority to Chinese patent application No. 200810071432.6 titled "SELF-DRIVING ROTARY DISPENSING DEVICE", filed with the Chinese State Intellectual Property Office on Jul. 18, 2008, and the benefit of priority to Chinese patent application No. 200910111270.9 titled "JET PUSH ROTARY SPRAY HEAD", filed with the Chinese State Intellectual Property Office on Mar. 9, 2009. The entire disclosure thereof is incorporated herein by reference.

BACKGROUND OF THE PRESENT INVENTION

1. Field of Invention

The present invention relates to sprinkling technology, in particular to a rotary spray device which is mainly applied in fire fighting field, and more specifically to a spray device used in automatic fire extinguishing system and in other spray applications such as spray dust removal, spray drying, spray combustion and spray irrigation.

2. Description of Related Arts

Conventional rotary sprays such as a centrifugal spray caused by forming film with a rotary disk, its rotational power comes from a motor. However, the motor driven system has a complex structure, a large volume, and needs a rotational power externally provided. Some rotary sprinkling devices driven by fluid, such as a rotary irrigation device, generate rotational sprinkling spray by impacting rotary wheel blades only with a water jet reaction force or with water flow to drive a spray nozzle disk, as disclosed in Chinese patents No. 03245269.1 and No. 99216638.1. Since they have a relatively large volume and rotational inertia, they rotate slowly, sprinkle or spray big liquid drops, and is difficult in miniaturization, which cannot meet the strict requirements of strong force and fine atomization.

In the fire fighting field, conventional water mist spray heads or fine water mist spray heads are fixed type spray heads. It is difficult for the fixed type spray head to uniformly and completely cover all fire in a whole space, and this affects the fire extinguishing effect. A Chinese invention patent No. 200510034232.X discloses a rotary spray fire extinguishing gun. Oblique slit-type water outlets arranged in fan blade shape are provided at the front end of the water nozzle body of the gun. The water nozzle body is rotated under the reverse impact force generated from spraying water through the oblique slit. The gun may sprinkle rotatably and uniformly. However, it has a large structure, rotates slowly, and sprays large water stream and large water drops, and thus cannot appropriately form mist and are not suitable for extinguishing oil fire.

The fine water mist fire extinguisher extinguishes fire on the basis of a phase change mechanism of water mist minute drop quick evaporation, rapid cooling and oxygen depriving smother fire extinguishing. It only uses one of several to ten odd of water used for conventional water spray and sprinkling fire extinguishing to extinguish large-scale fire relatively quickly. However, the basis achieving excellent fire extinguishing performance with the minute drop phase change is that a lot of fine water mist must be produced quickly and which fully absorb heat. The evaporation speed and heat absorption efficiency of water drops are inversely proportional to the effective area covered by water drops. Therefore, superfine atomizing and fully mixing with hot air are the keys to efficiently extinguish fire with fine water mist. The conventional pressure atomization small circular hole fixed spray mode has the following disadvantages which are difficultly resolved, e.g. a contradiction between flow rate and fine atomization and a contradiction between fine atomization and spray momentum. Therefore, the performance of conventional fixed fire fighting spray head is not ideal.

Similar to the requirements for extinguishing fire with the fine water mist, the substantive purpose of the spray drying and spray combustion is to quickly vaporize a large amount of liquid. In order to achieve this purpose, water is required to atomize into fine mist and to spray mist drops to a whole space, so as to be completely mixed with air, and so that the water droplets may fully contact with air to absorb more heat from air and then be vaporized into gas. The rotary spray can provide heat transfer conditions of allowing rapid evaporation of liquid mist. In addition, a wet dust removal requires small diameter of spray drops, a high speed, a full contact between the spray mist and fume or fine dust to increase the colliding capture rate to dust particle, and these features are suitable to using the rotary spray. How to use and exert the advantage of applying the working principle of the rotary spray in the above fields, to develop a simple, reliable fluid dynamic rotary spray device to meet the requirement of energy saving and environment protection, is a problem to be urgently solved.

SUMMARY OF THE PRESENT INVENTION

The invention is advantageous in that it provides a rotary spray device which may produce a large amount of fine water mist which may be quickly vaporized and rapidly decrease the temperature, meanwhile may produce a large amount of inert gas to achieve the object of extinguishing fire quickly and powerfully.

Another advantage of the invention is to provide a rotary spray which may be applied in other spray fields such as dust removal, drying or combustion to improve the working effect thereof.

Another advantage of the invention is to provide a jet push rotary spray device which may be automatically rotated under a reaction force of spray flow from the eccentric spray openings, and may solve the difficult problem of large-area uniform spray and fine atomization under a low or medium pressure.

One technical solution of the present invention is to provide a jet push rotary spray device.

The jet push rotary spray device includes a hollow seat body and a spray head body being rotatable relative to the seat body. The seat body is provided with a seat body cavity, and the entrance of the seat body cavity is threadedly connected with an external fluid input pipe. A fluid passage is provided inside the spray head body, and spray openings are provided outside the spray head body. Each spray opening communicates with the fluid passage which is in turn communicating with the entrance of the seat body cavity. The spray openings of the spray head body at least include two eccentric spray openings being symmetrical relative to the axis of the spray device. The centerline of each eccentric spray opening doesn't intersect with the centerline of the spray device. The spray flow reaction force of each eccentric spray opening may impart a rotation torque on the spray head body in the same direction, and the rotation direction of the rotation torque is identical with the tighten direction of the connection thread on the spray device. There are rotation engagement surfaces between the spray head body and the seat body, and the rotation engagement surfaces may be lubricated by liquid leaking through a rotation engagement surface clearance. The clearance of at least one of the rotation engagement surfaces, which is likely to leak liquid towards outside, may be designed as an annular spray opening. A small amount of fluid may be sprayed through the annular spray opening.

The annular spray opening is a rotation engagement surface clearance annular slot with or without an enlarged opening. A plurality of radial narrow ditches may be provided on one surface of the clearance annular slot. Preferably, the radial narrow ditches are in tangential radial shape, and the entrance section of each narrow ditch is larger than the outlet section thereof. An annular groove may be additionally provided at the inner side of the entrance of the above two kinds of clearance annular slot, and communicate with the fluid passage via a fluid introducing hole.

The spray head body is provided with a central sleeve-shaped hole, and the seat body is provided with a hollow shaft. The central sleeve-shaped hole of the spray head body is rotatably installed on the hollow shaft of the seat body. The hollow shaft is provided with a shrinkage hole concentric with the shaft hole of the hollow shaft. A communication hole communicating with the internal fluid passage of the spray head body is provided in the wall of the hollow shaft downstream of the shrinkage hole. The outlet of the shrinkage hole is blocked by a piston member abutting against a heat sensitive support component, and cut off the passage between the entrance of the seat body cavity and the communication hole. A base end plug of the heat sensitive support component is fixed at the end of the hole of the seat body hollow shaft. An upper annular surface and a lower annular surface of the spray head body are sandwiched between a circular step of the base end plug and an outer circular step of the seat body to axially position the spray head body, so as to form a closed type rotary spray device. The rotation engagement surface clearance annular slot formed between the lower annular surface of the spray head body and the outer annular step surface of the seat body is the annular spray opening. The rotation engagement surfaces may be lubricated by liquid leaking through the rotation engagement surface clearance. A small amount of fluid is sprayed through the annular spray opening when rotatedly spraying. Radial narrow ditches may be provided on the annular surface of the spray head body or the outer annular step surface of the seat body. Preferably, the radial narrow ditches are in tangential radial shape, and the entrance section of each narrow ditch is larger than the outlet section thereof. The narrow ditches may promote the leakage liquid spray and rotation.

The spray head body is provided with a central sleeve-shaped hole, and the seat body is provided with a hollow shaft. The central sleeve-shaped hole of the spray head body is rotatably installed on the hollow shaft of the seat body. A communication hole communicating with the internal fluid passage of the spray head body is provided in the wall of the hollow shaft. A plug in which a central atomizing core is provided is fixed at the end of the hole of the hollow shaft of the seat body. An upper and a lower annular surfaces of the spray head body are sandwiched between a circular step of the plug and the outer circular step of the seat body to axially position the spray head body. A plane rotation seal may be provided between the circular step surface of the plug and an upper annular surface of the spray head body. When spraying, a clearance annular slot is likely to be formed between the lower annular surface of the spray head body and the outer annular step surface of the seat body. The clearance annular slot and an enlarged opening at the periphery of the clearance annular slot are the annular spray opening. The rotation engagement surfaces may be lubricated by liquid leaking through the rotation engagement surface clearance. A small amount of fluid is sprayed through the annular spray opening when rotatably spraying. Radial narrow ditches may be provided on the annular surface of the spray head body or the outer annular step surface of the seat body. Preferably, the radial narrow ditches are in tangential radial shape, and the entrance section of each narrow ditch is larger than the outlet section thereof. The narrow ditches may promote the leakage liquid spray and rotation.

Atomizing cores and eccentric spray openings are provided at the periphery of the spray head body. An entrance pipe is provided at the center of the spray head body, and is rotatably received in the inner hole of the seat body. An upper annular surface and a lower annular surface are respectively provided at the inner hole and at the outlet of the seat body. An upper circular step or upper ring and a stop collar are provided at the periphery of an inlet end of the entrance pipe of the spray head body, and a lower circular step is provided at the periphery of an outlet end of the entrance pipe of the spray head body exposed outside the inner hole of the seat body. The upper and lower circular steps and the upper annular surface and lower annular surface of the inner hole of the seat body together axially position the spray head body. The rotation engagement surface clearance annular slot is formed between the lower circular step of the spray head body exposed outside the inner hole of the seat body and the outlet annular surface of the seat body, and is designed as the annular spray opening. An annular groove may be additionally provided at the inner side of the clearance annular slot of the annular spray opening, and communicate with the fluid passage via the fluid introducing hole. In addition, a spray opening may be provided in the bottom surface of the spray head body.

When adopting a structure of the present invention that the seat body is installed outside the entrance pipe of the spray head body, a leakage liquid clearance of the rotation engagement surface just is a circle of clearance annular slot, that is, it is designed as the annular spray opening. When adopting a structure of the present invention that the spray head body is installed outside the hollow shaft of the seat body, there are two clearance annular slots of the rotation engagement surfaces, i.e. upper and lower clearance annular slots. If one of clearance annular slots is designed as the annular spray opening, the other one should be provided with a rotation seal.

The spray head body is a spray head body having a shape of truncated polyhedral cone, cylinder or space generatrix revolving solid. Except the case that the three kinds of the spray head body is used in the closed type rotary spray device, further spray opening may be provided at the bottom of the spray head body. The eccentric spray openings may be provided at the periphery of the three kinds of the spray head body. The eccentric spray openings provided on the spray head body of the space generatrix revolving solid may be inclined spray openings with eccentric wedge groove and eye-like apertures, or inclined spray openings with eccentric wedge groove narrow slots.

The spray head body is a spray head body having approximately cross-shaped arms or assembled square body. The eccentric spray openings are provided on four side surfaces of the arms opposite to the rotation direction. The spray openings may be provided on the end surface of the spray head body or end surfaces of the arms. The eccentric spray openings may be provided at positions having the same eccentric distance on side surfaces of the square body, and the spray opening may be provided on the bottom surface of the square body.

The spray opening provided on the spray head body may have an atomizing core cavity in which an atomizing core is provided. The atomizing core is provided with a rotational flow passage, so as to allow the pressurized fluid to rotate in the atomizing core cavity and then form mist by the spray opening. The atomizing core at least includes an atomizing core with a single stage rotational flow cavity or swirler or vortical flow blades or a double-stage rotational flow core and an atomizing core with an annular slot or serial stage spray opening. A filter may be provided in the spray head with the atomizing core.

The spray opening having the atomizing core cavity in which various atomizing cores may be provided is an inclined spray opening, which is obliquely connected with the shrinkage conical hole of the atomizing core cavity, that is, the centerline of shrinkage conical hole of the atomizing core cavity obliquely intersects with the centerline of the spray opening.

The spray opening includes the non-torque conventional spray opening and the eccentric spray opening generating torque to the spray head body. The eccentric spray opening is a spray opening whose centerline deviates from the centerline of the spray head body. The eccentric spray opening may be an eccentric spray opening without atomizing core, or an eccentric spray opening having the atomizing core cavity in which an atomizing core is provided. The eccentric spray opening having the atomizing core cavity includes a eccentric spray opening concentric with the atomizing core cavity, an inclined spray opening not concentric with the atomizing core cavity or an inclined spray opening whose atomizing core is obliquely disposed in the atomizing core cavity seat.

By adopting the above technical solution, since at least two eccentric spray openings having an eccentric distance are provided at the outlet end of the fluid passage of the spray head body according to the present invention, when fluid is sprayed through the eccentric spray openings, a torque formed from the fluid spray reaction force is applied on the spray head body, and rotate the spray head body, and drive all spray openings (including non-torque conventional spray opening and the eccentric spray openings) on the spray head body to rotate together. For such structure, the spray head body may be rotated under a medium or low pressure, so as to achieve a quick, large-area uniform spray effect. In addition, the present invention may achieve a desired atomization sprinkling effect by changing the shape of the spray openings (for example, by providing eye-like aperture spray openings), or by directly fixing various atomizing cores on the spray head body.

Compared with the conventional rotary spray head, the present invention has a significant improvement.

The conventional fixed type fire extinguishing sprinkling spray head has disadvantages of large water drop, great water stain and non-uniform spray due to the limitation of the structure. The conventional water mist and fine water mist spray head are generally fixed. The fixed fine water mist spray head may spray fine mist, but the spray momentum is small, especially it is difficult to spray into flame deeply under the medium or low pressure. The fixed fire fighting spray head has a spray dead zone in the protection area, which may affect the fire extinguishing effect. Beside, the conventional rotary spray head is only used for the rotation sprinkling, instead of rotation spray mist, and the sprayed water drop and quantity are very big, so it is not suitable to many applications. Some rotary spray head capable of spraying mist have a complex structure.

A significant feature of the rotary spray device according to the present invention includes a simplified structure, which can be driven, lubricated by itself without additional mechanisms and external power and without rotation seal, and be formed only by assembling several parts. The substantive feature of the present invention is that the spray device provides a large flowrate superfine atomization mechanism and a high speed rotating pressure spray device formed of several assembled self-rotating mechanisms. The rotary spray device according to the present invention can greatly improve the spray fire extinguishing ability, and has not the spray blind zone. The mist drop of the rotary spray device has the centrifugal force and tangential velocity caused by the spray head rotation to cause the violent disturbance of air, and cause violent collision, friction and mix with air. Thus, it can greatly promote fine atomization and quickly vaporize into a large volume of steam, and has the prominent advantages of rapid cooling and oxygen depriving smother fire extinguishing and achieves a powerful fire extinguishing effect.

The device of the present invention can increase both the atomization speed and flowrate and the spray momentum, and thus can spray into flame in the fire scene under the medium or low pressure, thereby having a good rotary spray fire extinguishing effect. An outstanding advantage of the invention is to provided many kinds of appropriate spray head bodies, atomizing cores or/and spray openings, and can be flexibly combined to meet the different requirement of spray flowrate, fineness and spray angle. In particular, the device of the present invention may be made as a opened type rotary spray device or a closed type rotary spray device, which can be applied to both a opened type fire extinguishing system and a closed type fire extinguishing system to meet different requirements in many applications. Another outstanding advantage of the invention is to use leakage liquid, which is harmful in the conventional device, for rotation lubrication and spray formation. There must be a clearance between the rotation engagement surfaces of the seat body and the spray head body, which causes a problem that pressurized fluid may leak towards outside. In the prior art, the leakage is solved by providing a rotation seal, which complicates the structure of the spray head and increase the rotation resistance, that is, inconvenient for the rotation spray. The present invention overcomes the prejudice, and provides a new solution which is utilization and facilitation of leakage, that is, providing no or less seal but utilizing leakage clearance or/and additionally providing radial narrow ditches as the leakage liquid spray openings. It allows the leakage liquid to be sprayed, and turns harm into advantage, which especially facilitates to simplify the structure of the spray device and improve the performance of the rotary spray.

The present invention not only solves the problem of rotary spray, but also simplify the structure of the bulky and complex rotary spray head (generally provided with a rolling bearing), and may significantly improve the spray quality and spray effect.

Another technical solution of the present invention solving the technical problems is to provide a self-driving rotary spray device which performs a self-rotating spray in hydraulic internal drive mode so as to allow a rapid uniform spray in a large area under the medium or low pressure.

In order to solve the above technical problem, another technical solution of the present invention is to provide a self-driving rotary spray device.

The self-driving rotary spray device includes a seat body in which a seat cavity is provided and a spray head body in which a fluid passage is provided. The entrance of the seat cavity is connected to an external input flow pipe. At least one spray nozzle or/and spray head is provided at an output end of the fluid passage. The spray head body is a rotor body. The spray nozzle or/and spray head, which are provided in the spray head body, and the spray head body are approximately a rotation balance body. The input end of the fluid passage of the spray head body is rotatably connected with the seat body by a connection component, and communicates with the seat cavity. The rotary spray device is further provided with a drive mechanism which generates a torque for rotating the spray head body under a fluid flow push force. The drive mechanism at least includes a kind of driven impeller which is provided in the pressurized fluid cavity between the seat body and the spray head body. The drive mechanism rotates with the spray head body.

The drive mechanism further includes at least two eccentric spray nozzles provided at the periphery of the spray head body. The shape of the spray head body and the shape and distribution of the spray nozzle or spray head provided on the spray head body are generally in a space rotation symmetry form around the axis of the spray head body. There is an eccentric distance between the projection of the spray centerline of the eccentric spray nozzle on the plane perpendicular to the axis of the spray head body and the axis center of the spray head body, and the spray direction of the eccentric spray nozzle is opposite to the rotation direction of the spray head body pushed by the impeller.

The driven impeller has funnel-shaped blades or sheet blades receiving an impact of a rotational flow. Correspondingly, a circle of rotational flow spray openings are fixed in the seat cavity outside the impeller. The impeller is fixed at the input end of the spray head body, or is fixed on the connection component fixedly connected with the spray head body.

The driven impeller is an axial flow type or semi-axial flow type paddle-shaped impeller having inclined blades. The impeller is fixed at the input end of the spray head body, or is fixed on the connection component fixedly connected with the spray head body.

The connection component is a rolling bearing, steel ball component or swivel sliding bearing.

The connection component is a rotary connector. The rotary connector includes internal connector and external connector having input and output openings, a bearing device and a seal. The seat body is fixedly connected with the internal connector of the rotary connector, or the seat body and the internal connector are formed as one piece. The spray head body is fixedly connected with the external connector of the rotary connector. The driven impeller is fixed on the input end of the spray head body, or is fixed on the external connector of the rotary connector fixedly connected with the spray head body. The impeller receives the fluid flow push forces and generates the rotation torque, and then drives the rotary connector and the spray head body to rotate together.

The spray head body is at least one cross-shaped body in which a cross-shaped fluid passage is provided. One eccentric spray nozzle is provided on each cross arm of the spray head body in a counter rotation direction, and angularly communicates with the fluid passage.

The spray nozzle or eccentric spray nozzle at the periphery of the spray head body is an eye-like aperture spray nozzle.

The spray head body is an independent spray head. The spray head or the spray head at the output end of the fluid passage may be a fine water mist spray head, water mist spray head, foam or foam mist spray head, big water drop spray head, spray gun or spray head using oil or other fluids.

The seat body is a heat sensitive normally closed valve, and the rotary spray device becomes a closed type rotary sprinkling device which is opened by the control of the heat sensitive element.

A plurality of big through holes is provided at the output end of the fluid passage of the spray head body. A fine atomizing core spray nozzle is inserted in each big through hole to form a self-driving fine mist rotary spray device.

The spray head body or spray head may be long hard tube spray gun, long hose spray gun, or liquid-gas ejector type venturi atomization spray gun. The liquid-gas ejector type venturi atomization spray gun includes an atomization spray nozzle, an air introduction chamber with air suction holes, a throat pipe and a diffuser spray pipe.

By adopting the above technical solutions, since the driven impeller being rotated together with the spray head body is provided one pressure cavity in the present invention, the spray head body may be rotated under a driven torque of the driven impeller generated from all fluid flow push force, or may be rotated under a resultant torque of the driven torque and a jet push torque. Therefore, the spray head body may be quickly rotated under the medium lower pressure, so as to achieve a rapid, large-area spray effect. Furthermore, the present invention may achieve an atomization sprinkling effect by changing the shape of the spray nozzle (eye-like aperture spray nozzle), or by directly providing big through hole at the spray nozzle to insertedly fixing various fine water atomizing cores.

The present invention combines the combined rotary advantages of the above two technical solutions to provide a rotary spray device which is varied, characterized and suitable for different uses.

More specifically, advantages of the present invention are that the spray head body is quickly rotated by the energy of fluid without the drive of external forces, and the structure is simplified, and especially the spray quality and effect are more greatly improved than that of the fixed spray head. The rotary spray may overcome the following disadvantages of the fixed spray head: a) due to the limitation of the structure, the conventional fixed spray head has spray dead zone when spraying or sprinkling, and it is difficult to fully mix with the ambient medium; b) the sprinkling impulse of the conventional fixed spray head is limited, especially when spraying fine mist, water drops are small, and the spray does not go further under the medium or low pressure, and such small momentum spray cannot spray in the whole space. However, the rotary spray can overcome the above two serious disadvantages of the fixed spray head. The rotary spray is a full space rotation sprinkling, and doesn't have a blind zone. The mist drop of the rotary spray has the centrifugal force caused by the spray head rotation and thus may be sprayed further. Besides, the spray momentum is large. The self-driving rotary spray device according to the present invention may be various of rotary spray head of water spray type, fine water mist type, gas-water mist type, foam type, foam spray type etc. Therefore, the present invention is suitable for a large-space fire extinguishing and other water fire extinguishing applications, and develops a new road for the application of green environmental protection of medium-low pressure fine water mist fire extinguishing system. In addition, the rotary spray device according to the present invention may utilize water, oil or other liquids, and also may utilize other wording medium such as gas-liquid two phase fluid, or gas-liquid-power multi-phase flow. The rotary spray device according to the present invention may applied in other spray fields, thereby has a wide application range. These and other objectives, features, and advantages of the present invention will become apparent from the following detailed description, the accompanying drawings, and the appended claims.

BRIEF DESCRIPTION OF THE DRAWINGS

FIG. 1-1 is a schematic structural view of the spray head body in another form of embodiment 1 shown in FIG. 1.

FIG. 1-2 is a schematic view seeing from direction A of FIG. 1-1.

FIG. 2 is a schematic structural view of embodiment 2 according to the present invention.

FIG. 2-1 is a schematic view seeing from direction B of FIG. 2.

FIG. 2-2 is a schematic section view along line E-E of FIG. 2.

FIG. 3-1 is a schematic section view along line K-K of FIG. 3.

FIG. 3-2 is a structural section view of another inclined spray opening of FIG. 3.

FIG. 3-3 is a section view along line D-D of FIG. 3-2.

FIG. 4-1 is a schematic structural view of an atomizing core having a rotational flow inclined spray opening according to the present invention.

FIG. 6-1 is a schematic view seeing from direction C of FIG. 6.

FIG. 6-2 is a schematic view seeing from direction J-J of FIG. 6, illustrating the spray.

FIG. 7-1 is a schematic view seeing from direction M of FIG. 7.

FIG. 9-1 is a schematic view of section T-T of FIG. 9.

FIG. 9-2 is a schematic view of another impact impeller of section T-T of FIG. 9.

FIG. 9-3 is a schematic view of further impact impeller of section T-T of FIG. 9.

FIG. 10-1 is a view seeing from direction G-G of FIG. 10.

FIG. 12-1 is a schematic view of section F-F of FIG. 12.

FIG. 12-2 is a schematic structural view of a rotor atomizing core having a spray nozzle with striking holes according to the present invention.

DETAILED DESCRIPTION OF THE PREFERRED EMBODIMENT

Hereinafter, the present invention will be described in detail with reference to drawings and specific embodiments.

Embodiment 1

Figure 1:
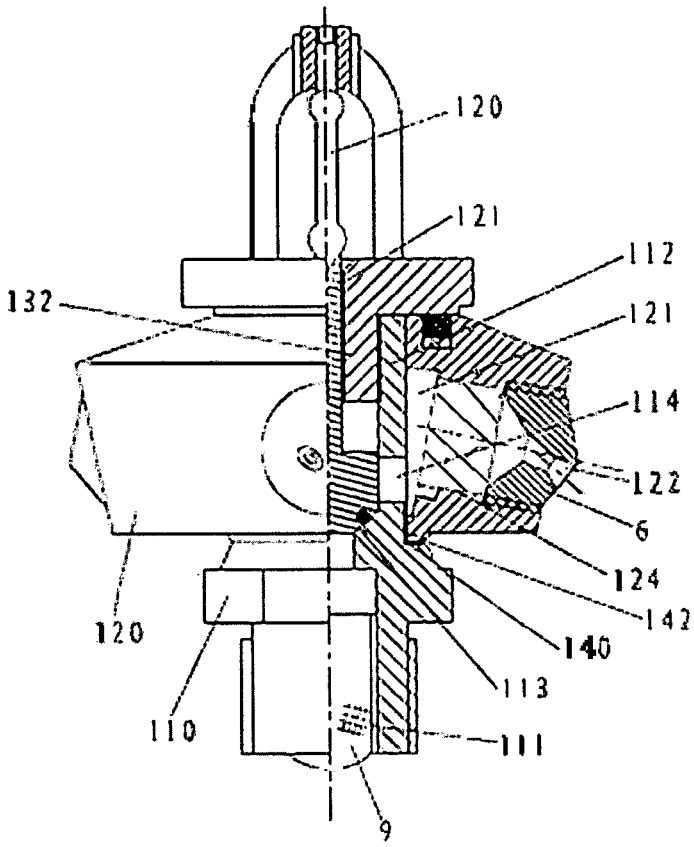
FIG. 1 is a schematic structural view of embodiment 1 according to the present invention.
Figure 1:
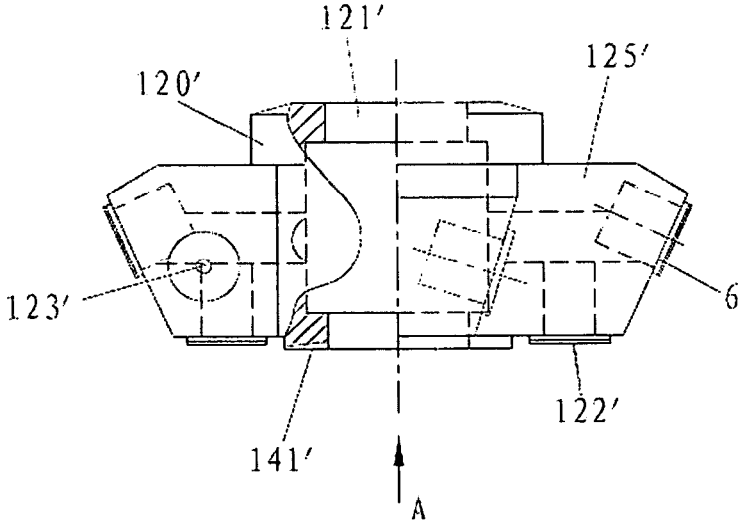
Figures 1, 2:
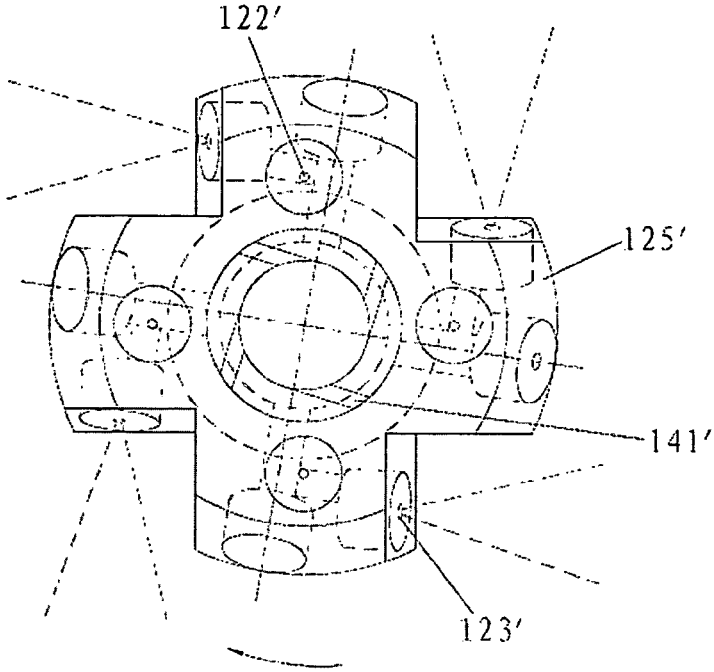
Figure 2:
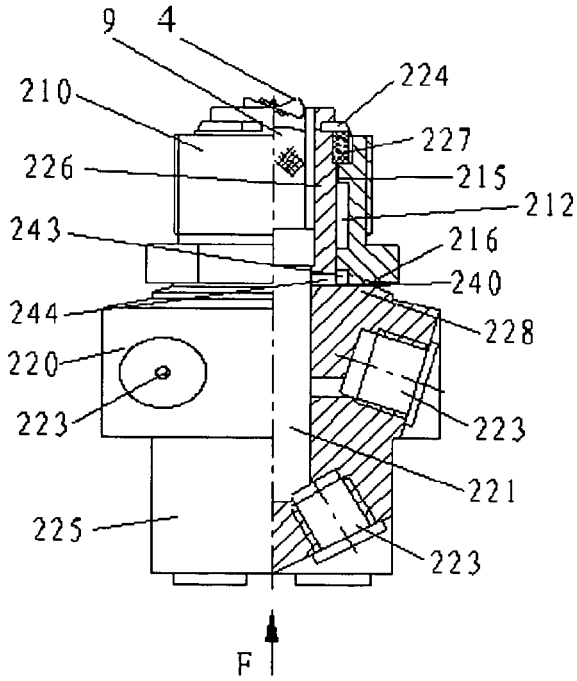
Figures 1, 2:
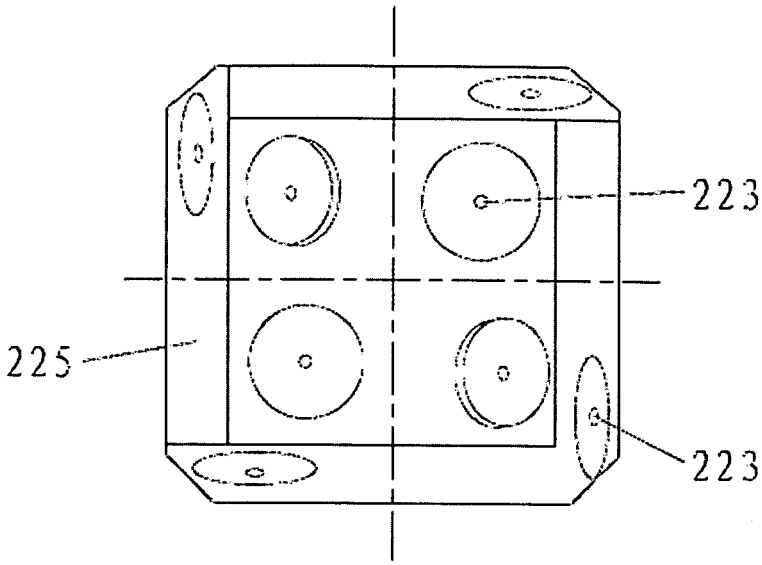
Figure 2:
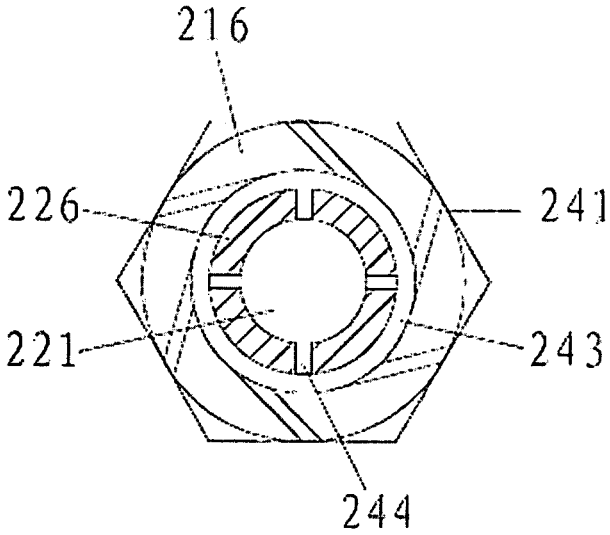

Referring to FIGS. 1, 1-1 and 1-2, the jet push rotary spray device according to the embodiment is a jet push rotary closed type spray device with a sleeved type spray head body, which mainly includes a seat body 110 and a spray head body 120 (as shown in FIG. 1).

The seat body 110 has a hollow structure, and has an entrance 111 provided at one end of the seat body 110. A filter 9 is provided in the entrance 111. An outer surface of the entrance 111 is threaded to connect with an input flow pipe (not shown in the drawings). The seat body 110 is further provided with a hollow shaft 112. Rotational flow openings 114 are disposed along the axial direction of the hollow shaft 112 and formed by inclined through holes on the wall of the hollow shaft 112.

The spray head body 120 is a rotor body, and may be embodied in various shapes. In this embodiment, the spray head body 120 is a truncated polyhedral cone with a central through hole. The spray head body 120 is rotatably installed on the hollow shaft 112 of the seat body 110, and an annular cavity is formed between the spray head body 120 and the hollow shaft 112. A fluid passage 121 is provided within the spray head body 120. The input end of the fluid passage 121 communicates with four rotational flow openings 114 on the hollow shaft 112 of the seat body 110 via the annular cavity. Atomizing core cavities 124 are evenly disposed on the circumference wall of the annular cavity of the spray head body 120. Atomizing cores 6 are disposed in the atomizing core cavities 124, and have inclined spray openings 123 which may generate eccentric spray flow so as to form eccentric spray openings. The atomizing core 6 is provided with inclined groove on its outer circumference. The inner end of the atomizing core 6 is a protruding portion. The protruding portion is exposed outside the entrance of the atomizing core cavity 124, and protrudes from the inner wall of the annular cavity. There is an eccentric distance between the projection line of the centerline of the inclined spray openings 123 on the plane perpendicular to the axis of the spray head body and the centre of the spray head body 120, so as to form the eccentric spray openings. Besides, the arrangement direction of the inclined spray openings 123 allows the spray head body 120 to rotate in the same direction.

When a pressurized fluid is outputted, reaction force of eccentric spray flows generated from the inclined spray openings 123 is exerted on the spray head body 120 so as to generate torque in the same rotation direction. Preferably, the rotation direction of torque is identical with the tightened direction of the outer thread of the entrance 111. At the same time, swirling flow is output from the rotational flow openings 114 towards the annular cavity, and strikes against the protruding portion of the inner end of the atomizing core 6, so as to rotate the spray head body 120. Therefore, the inner wall of the annular cavity of the spray head body having the protruding portion of the atomizing core 6 is formed as impellers. The direction of torque generated from the impellers is identical to the direction of torque generated from the eccentric spray openings, so that the spray head body 120 is rotated under the action of them.

In addition, a shrinkage hole 113 is provided within the hollow shaft 112 of the seat body 110. The piston member 131 may block the outlet of the shrinkage hole 113, and stop the communication between the entrance 111 of the seat body 110 and the fluid passage 121 in the spray head body 120. A heat sensitive support component 130 is arranged to tightly bias against the piston member 131, and a base end plug 132 of the heat sensitive support component 130 is fixed at an end of a hole of the hollow shaft 112 of the seat body 110. An upper annular surface and a lower annular surface of the spray head body 120 are located between a circular step surface of the base end plug 132 and a circular step surface of the seat body 110, so that the rotatable spray head body 120 is positioned in axial direction to form a closed type rotary spray device.

In the operation of this embodiment, when fire hazard occurs and indoor temperature reaches a predetermined value, the heat sensitive support component 130 falls off, and thus the support to the piston member 131 ceases to exist. As a result, the piston member 131 is disengaged from the outlet of the shrinkage hole 113 under a fluid pressure at the entrance 111, so that the entrance 111 of the seat body 110 communicates with the rotational flow openings 114. The fluid came from the entrance 111 of the seat body 110 flows through the rotational flow openings 114 within the hollow shaft 112, and rotationally flow into the annular cavity of the fluid passage 121 of the spray head body 120 so as to rotate the hole-type impeller of the spray head body, and then passes through the atomizing core 6 in the atomizing core cavity 124, and finally is sprayed out via the inclined spray openings (i.e. the eccentric spray openings 123) of the atomizing core 6. When the fluid is sprayed out via the inclined spray openings, eccentric spray flow is formed. The rotation of the spray head body is accelerated under both the inner driving force of the hole-type impeller and the outer driving force of the eccentric spray openings. Such high speed rotating spray violently collides, makes friction and mixes with ambient air, and strongly promotes the fine atomization and quick evaporation of the fluid so as to form thick fine mist cloud, and thus achieve a uniform spray effect.

In addition, there exists a lower clearance annular slot formed between the outer annular step surface of the seat body 110 and the lower annular surface of the spray head body 120 and an upper clearance annular slot formed between the annular step surface of the base end plug 132 and the upper annular surface of the spray head body 120. The lower and upper clearance annular slots form rotation engagement surfaces. A seal may be provided at the upper clearance annular slot, and only the lower clearance annular slot is designed as an annular spray opening 140. Alternatively, both the upper clearance annular slot and the lower clearance annular slot are designed as annular spray openings. When water is supplied, the fluid permeates the rotation engagement surfaces to lubricate them, so that the spray head body 120 may be smoothly rotated on the seat body 110. A small amount of fluid passes through the annular spray opening 140 at the rotation engagement surface, which may achieve the mist shape spraying effect since the clearance is relatively small. A small enlarged opening 142 may be or not provided at the outer circumference of the annular spray opening 140.

As shown in FIGS. 1-1 and 1-2, the spray head body 120' in another form of the closed rotary spray device of embodiment 1 is shown. The spray head body 120' includes an approximate cross-shaped arm 125', and the central through hole of the spray head body 120' is rotatably fitted on the hollow shaft of the seat body 110. Eccentric spray openings 123' are disposed at eccentric positions on four side surfaces, which are opposite to the rotation direction, of the arms. The eccentric spray openings 123' communicate with a fluid passage 121' disposed in the spray head body 120'. Alternatively, an atomizing core cavity communicating with the fluid passage 121' may be provided to fix the atomizing core 6 having straight spray openings. Though the straight spray openings of the atomizing core 6 is not eccentrically disposed relative to the atomizing core 6, the straight spray openings of the atomizing core 6 may be considered forming as the eccentric spray openings 123' since the atomizing core 6 is eccentrically disposed relative to the spray head body 120'. The eccentric spray openings or/and non-eccentric conventional spray openings 122' may be provided in the outer end surface or bottom surface of each arm 125'. The shape of the spray head body 120' may be a polyhedral cone shape or a cylinder shape.

In addition, a plurality of radial narrow ditches 141' may be provided on the lower annular surface of the spray head body 120'. The radial narrow ditches 141' are preferably disposed in tangential radial manner, wherein the entrance is larger and the outlet is smaller. The lower annular surface of the spray head body 120' provided with the radial narrow ditches is engaged with the outer annular step surface of the seat body, so as to form the annular spray openings of the rotation engagement surface. When water is sprayed, the radial narrow ditches 141' may guide water towards outside, and improve the spray effect of the annular spray openings.

The above embodiment 1 may be modified into a jet push rotary opened type spray device with a sleeved type spray head body, referring to FIG. 1.

The piston member 131, the shrinkage hole 113, the heat sensitive support component 130 and the base end plug 132 in the closed type spray device of the embodiment 1 are removed, but a plug (not shown) in which central spray cores and central spray openings are provided is fixed at the end of the hole of the hollow shaft 112 of the seat body 110. The upper annular surface and the lower annular surface of the spray head body 120 are located between a circular step of the plug and the outer circular step of the seat body 110, so that the spray head body 120 is positioned in axial direction. In this way, the orientation of the atomizing core cavity and the eccentric spray openings should correspond to the orientation of the central spray openings, so that their spray orientations correspond to fire extinguishing direction. Thus, the jet push rotary opened type spray device with the sleeved type spray head body may be formed without modifying other elements.

The term "closed type" means that the spray device includes the heat sensitive component and so on; and the term "opened type" means that the spray device does not include the heat sensitive component and so on.

Embodiment 2

As shown in FIGS. 2, 2-1 and 2-2, the jet push rotary spray device according to the embodiment also includes the seat body 210 and the spray head body 220.

The seat body 210 has a hollow structure, and its outer wall is threaded to connect with an input flow pipe (not shown in figures). An upper annular surface 215 and a lower annular surface 216 are respectively provided above the inner hole 212 of the seat body 210 and at the outlet.

An entrance pipe 226 is provided above the spray head body 220, and an analogy assembled square body 225 is provided below the spray head body 220. The entrance pipe 226 is rotatably inserted in the inner hole 212 of the seat body 210. A circular step 227 and a collar 224 are provided on the outer circumference of the entrance end of the entrance pipe 226 of the spray head body 220. The top circular ring of the periphery of the spray head body 220 exposed outside the inner hole 212 of the seat body 210 forms a lower circular step 228 and an upper circular step 227. The upper annular surface 215 and the lower annular surface 216 of the inner hole 212 of the seat body 210 are interposed between the upper circular step 227 and the lower circular step 228, so as to position the spray head body 220 in the axial direction. A clearance annular slot is formed between the lower circular step 228 of the spray head body 220 exposed outside of the inner hole 212 of the seat body 210 and the lower annular surface 216 of the seat body 210. The annular slot may be designed as an annular spray opening 240, to form a rotation engagement surface. Tangential radial narrow ditches 241 (referring to the schematic section view along line E-E of FIG. 2, i.e. FIG. 2-2) may be further provided on the annular spray opening 240, and an annular groove 243 may be additionally provided at the inner side of the annular spray opening 240. The annular groove 243 directly communicates with the fluid introducing hole 244 of the fluid passage 221. The radial narrow ditches 241 and the fluid introducing hole 244 may improve the fluid spray effect of the annular spray opening 240.

In addition, the filter 9 is provided in the entrance pipe 226 of the spray head body 220. The fluid passage 221 is provided within the inside of the analogy assembled square body 225. The spray openings are provided at the positions with the same eccentric distance on respective surfaces of the analogy assembled square body 225 to form the eccentric spray openings 223. The spray openings are further provided on the bottom surface of the analogy assembled square body 225 and form as the conventional spray openings. In addition, the impeller 4' is fixed at an end portion of the entrance pipe 226, so that, when the fluid passes through, the impeller 4' may generate torque for driving the spray head body 200 to rotate in the same manner as that disclosed in embodiment 1.

The above embodiment 2 may be modified by replacing the analogy assembled square body 225 with the approximate cross-shaped arms shown in FIG. 1-1 so as to form a jet push rotary spray device structure in which the entrance pipe of the rotatable spray head body is inserted in the seat cavity of the seat body.

Embodiment 3

Figure 3:
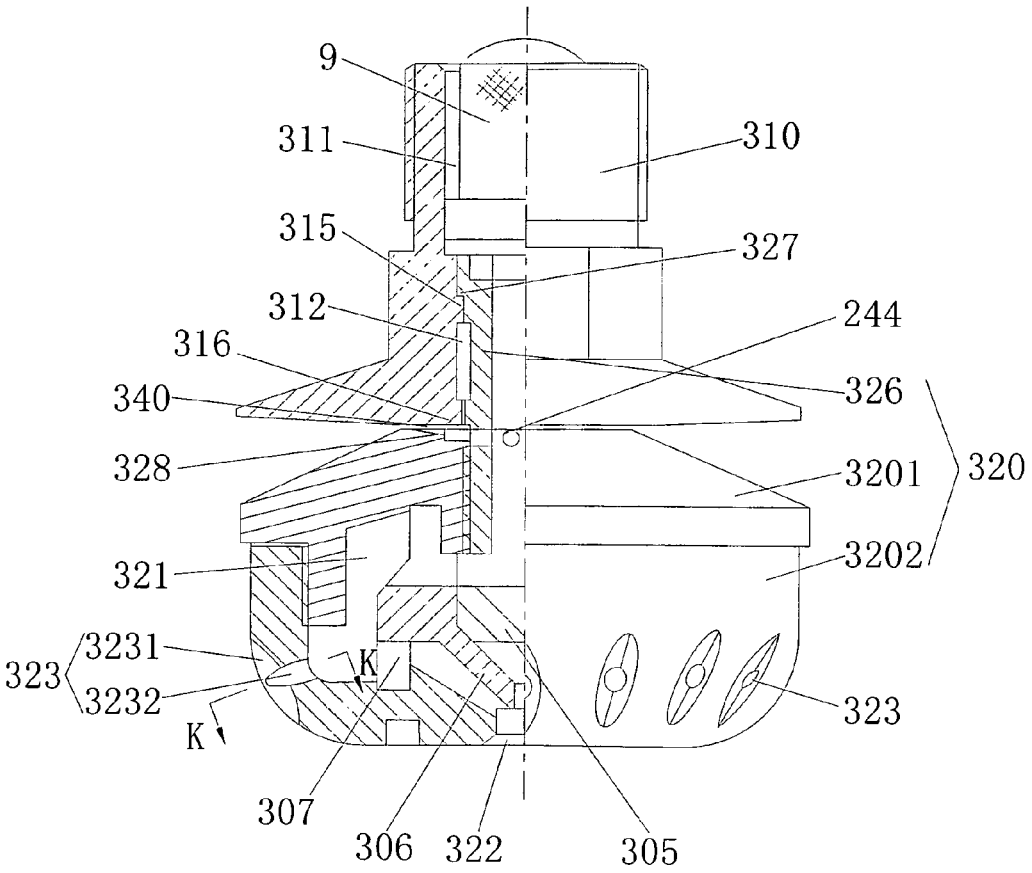
FIG. 3 is a schematic structural view of embodiment 3 according to the present invention.
Figures 1, 3:
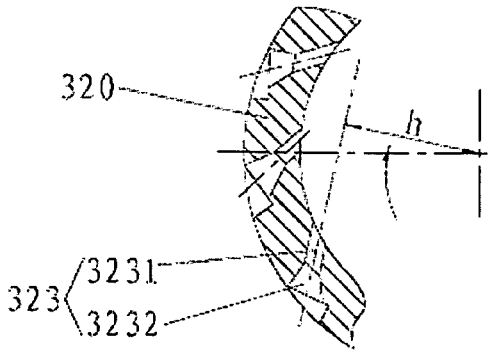
Figures 2, 3:
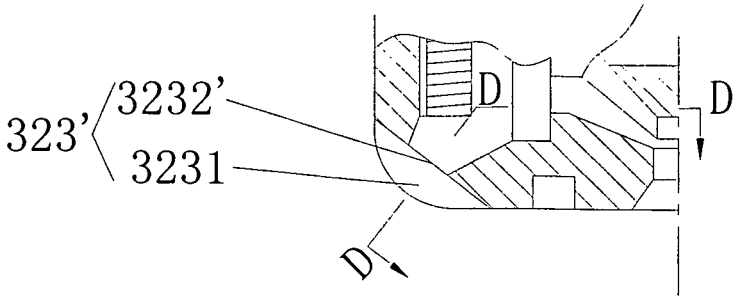
Figure 3:
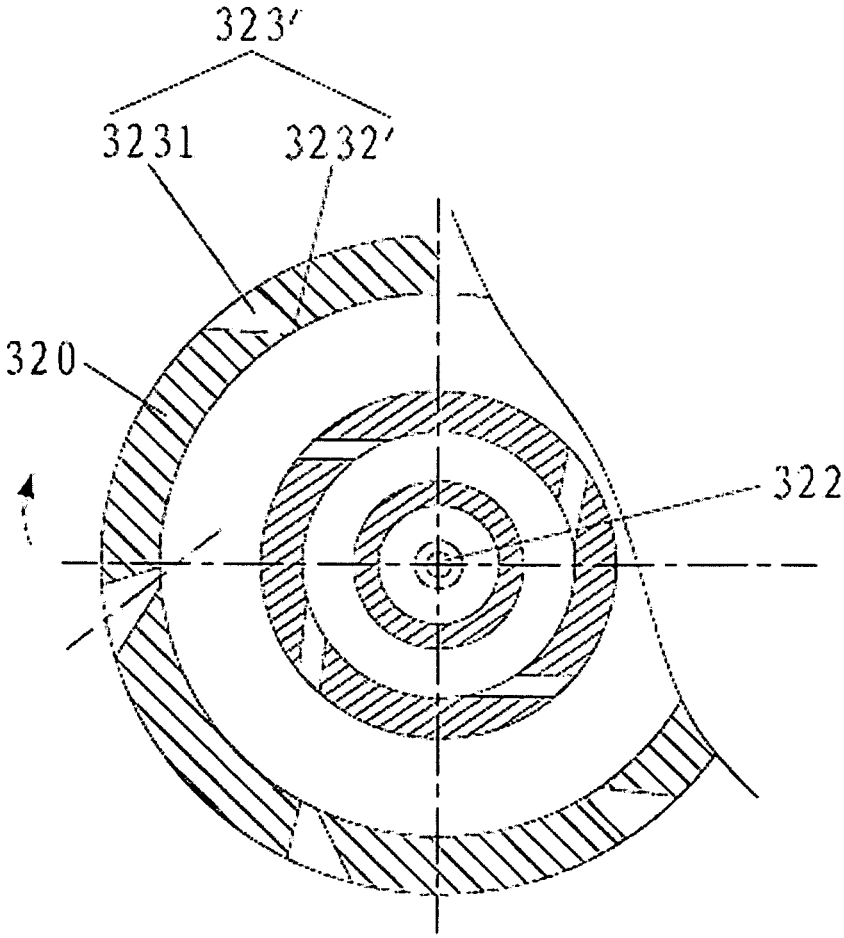

As shown in FIGS. 3, 3-1, 3-2 and 3-3, the jet push rotary spray device according to the embodiment also includes the seat body 310 and the spray head body 320.

The seat body 310 is hollow in structure, wherein an entrance 311 is provided at one end of the seat body 310. A filter 9 is provided in the entrance 311. The outer surface of the entrance 311 is threaded to connect with an input flow pipe (not shown in Figures). An upper annular surface 315 and a lower annular surface 316 are respectively provided above the inner hole 312 of the seat body 310 and at the outlet.

The spray head body 320 is a space generatrix revolving solid. The cavity inside the spray head body 320 forms a fluid passage 321. The spray head body 320 includes an entrance pipe 326, a spray head body seat 3201 and a spray head body main part 3202 which are separate components. The entrance pipe 326 is rotatably inserted in the inner hole 312 of the seat body 310 to play a role of positioning in the radial direction. The entrance pipe 326 is threadedly connected with the upper portion of the spray head body seat 3201, and the spray head body main part 3202 is threadedly connected with the lower portion of the spray head body seat 3201. An upper circular step 327 is provided on the outer circumference of the entrance end of the entrance pipe 326 of the spray head body 320, and a lower circular step 328 is formed on the top edge of the spray head body seat 3201 exposed outside the inner hole 312 of the seat body 310. The upper circular step 327 and the lower circular step 328 are respectively engaged with the upper annular surface 315 and the lower annular surface 316 of the inner hole 312 of the seat body 310, to form two engagement surfaces for positioning the spray head body 320 in the axial direction. A clearance annular slot is formed between the lower circular step 328 of the spray head body seat 3201 exposed outside of the inner hole 312 of the seat body 310 and the lower annular surface 316 of the seat body 310. The clearance annular slot is designed as an annular spray opening 340, to form a rotation engagement surface. Radial narrow ditches (not shown in figures) may be provided in the clearance annular slot to guide fluid towards outside and improve the spray effect. A small amount of fluid passes through the clearance annular slot or/and the radial narrow ditches to be sprayed. Similarly, the impeller 4' is fixed at the end portion of the entrance pipe 326, to generate the torque for driving the spray head body 200 to rotate.

A plurality of inclined spray openings 323 (as shown in FIG. 3-1) having eccentric wedge grooves 3231 and eye-like apertures 3232 are provided at the outer circumference of the spray head body 3202. There is an eccentric distance h between the spray centerline of the inclined spray openings 323 and the axial center of the spray head body 320, so as to form eccentric spray openings with another structure. Thus, the spray driving torque of the inclined spray openings 323 equals to the product of the resultant force of jet reaction forces with h. In this way, another jet push rotary spray device is formed.

The inclined spray openings 323 having the eccentric wedge grooves 3231 and the eye-like apertures 3232 may be formed as inclined spray openings 323' having the eccentric wedge grooves 3231 and narrow slots 3232' (as shown in FIGS. 3-2 and 3-3).

The above inclined spray openings 323 or 323' are provided with the eccentric wedge grooves 3231 enlarging towards outside at the outer periphery of the eye-like apertures 3232 or narrow slots 3232'. After water is sprayed from the smaller eye-like aperture 3232 or narrow slots 3232', the water is formed into a membrane shape in the quickly enlarged eccentric wedge grooves 3231. Thus, fine water mist may be sprayed. In this way, a jet push fine water mist spray device is formed.

In addition, as shown in FIG. 3, a conventional spray opening 322 which does not generate a torque may be provided at the center of the bottom of the spray head body 320 according to the embodiment. The fluid is supplied from a double-stage rotational flow core to the spray opening 322. The double-stage rotational flow core includes a central rotational flow atomizing core 305 and a double rotational flow atomizing core seat 306. The central rotational flow atomizing core 305 is provided in the fluid passage 321 of the spray head body 320, and is fixed on the double rotational flow atomizing core seat 306. The double rotational flow atomizing core seat 306 is fixed on the spray head body seat 3201, and tangential grooves 307 are opened on the side wall of the double rotational flow atomizing core seat 306. The spray opening of the central rotational flow atomizing core 305 and the spray opening 322 form double spray openings. When the spray opening of the central rotational flow atomizing core 305 and the spray opening 322 are in series relative to the same axis, i.e. one being outside and the other being inside, series stage spray openings are formed. Since the above formed double spray openings are disposed so as to not generate torque, the conventional spray opening 322 is formed.

The spray openings or the eccentric spray openings on the spray head body may be constructed of spray cores in various structures. The specific structure of the atomizing core may be varied, and a few kinds of spray cores are illustrated in the present invention.

Figure 4:
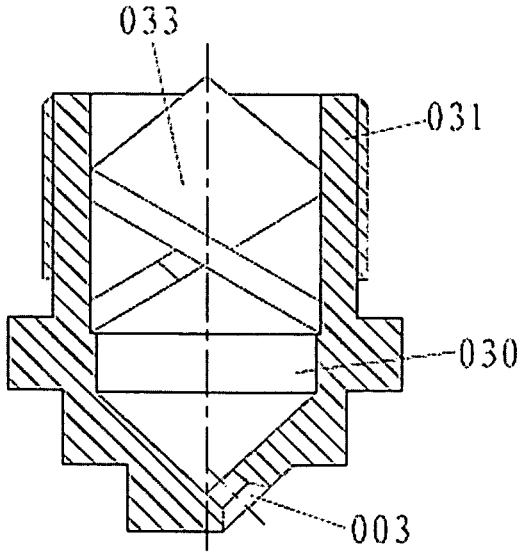
FIG. 4 is a schematic structural view of an atomizing core having a vortical flow inclined spray opening according to the present invention.
Figures 1, 4:
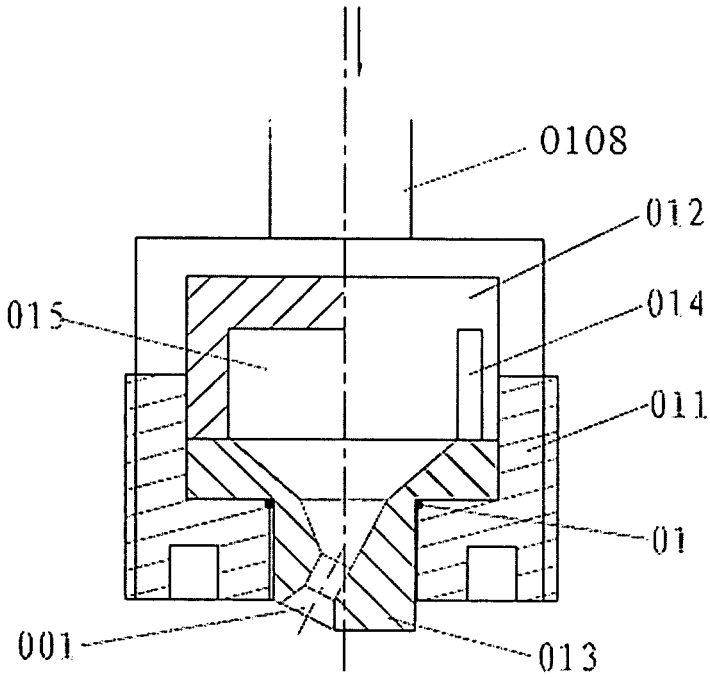

FIG. 4 is a schematic structural view of an atomizing core having a vortical flow inclined spray opening.

A rotational flow cavity 030 is provided in an atomizing core seat 031 with outer thread. A vortex flow core 033 is provided in the rotational flow cavity 030. A rotational flow passage is provided in the vortex flow core 033. The vortex flow core 033 is of an integral separated-leaf structure, and two leaf flow guiding piece, which are inclined in opposite directions with each other, are disposed at two sides of the upright flat sheet at the center of the vortex flow core 033. Two opposite semicircle contours of the flow guiding pieces are tightly fitted with the hole of the rotational flow cavity. A shrinkage conical hole of the rotational flow cavity is connected with the spray opening 003 which is obliquely crossed with the centerline of the atomizing core cavity, so as to form an inclined spray opening 003.

FIG. 4-1 is a schematic structural view of an atomizing core having a rotational flow inclined spray opening. A rotational flow sleeve 012 and a spray opening seat 013 are installed in the cavity of the core seat 011 of the spray core. An inclined spray opening 001 is provided in the spray opening seat 013. The top wall of the rotational flow sleeve 012 is enclosed. A single-stage rotational flow cavity 015 is formed inside the rotational flow sleeve 012, and 2 to 4 rotational flow passages may be provided on the annular wall of the rotational flow sleeve 012. The rotational flow passages in the embodiment in figures are tangential grooves 014. The inner hole of the rotational flow sleeve 012 is closely engaged with the entrance of the funnel-shaped hole of the spray opening seat 013. The funnel-shaped hole communicates with the inclined spray opening 001. The spray opening seat 013 is rotatable relative to the core seat 011, and a seal 01 is provided between the spray opening seat 013 and the core seat 011. An input hole 0108 of the cavity of the atomizing core is provided at the bottom portion of the cavity.

The above atomizing core having the inclined spray opening further includes a double-stage rotational flow core provided in the cavity of the atomizing core and a double spray opening. The atomizing core cavity in which various atomizing cores may be provided includes the inclined spray opening. The inclined spray opening is obliquely connected with the shrinkage conical hole of the atomizing core cavity, i.e. the centerline of the shrinkage conical hole of the atomizing core cavity is obliquely crossed with the centerline of the spray opening.

Figure 5:
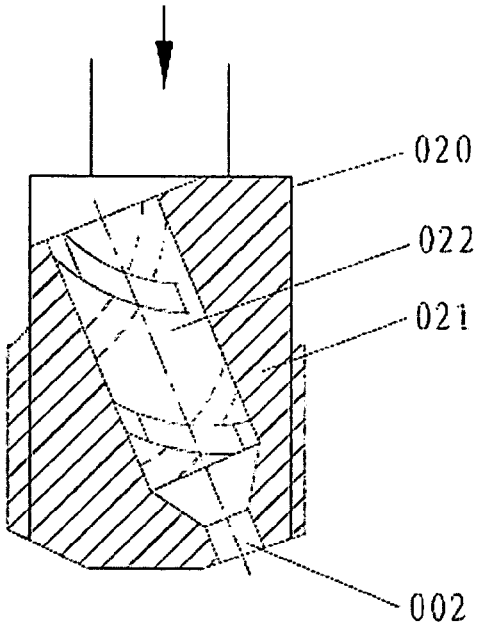
FIG. 5 is a schematic structural view of an atomizing core having an inclined-disposed swirler according to the present invention.

FIG. 5 is a schematic structural view of an inclined-disposed swirl atomizing core. A cylinder swirl hole with shrinkage spray opening 002 is obliquely disposed in the atomizing core seat 021 with outer thread. A cylinder swirl 022 is disposed in the swirl hole, and two threaded swirl holes and the spray openings are evenly disposed on the outer cylinder surface of the swirl 022. The centerline of the cylinder swirl 022 is obliquely crossed with the centerline of the atomizing core seat 021.

All of the above spray openings of the spray cores are the inclined spray openings, or are the inclined eccentric spray openings. However, the spray opening of the atomizing core may be disposed as the straight spray opening which is not eccentric. When the atomizing core having the inclined spray opening is disposed in the non-eccentric atomizing core cavity of the spray head body, the eccentric spray opening may be formed. Besides, when the atomizing core having the straight spray opening is disposed in the eccentric atomizing core seat cavity of the spray head body, the eccentric spray openings may also be formed. The eccentric spray opening is a spray opening which is provided in the atomizing core cavity deviating from the center of the spray head body, and the centerline of the eccentric spray opening doesn't intersect the centerline of the spray head body. The eccentric spray opening includes the spray opening which is concentric with its atomizing core cavity, and the spray opening which is not concentric with its atomizing core cavity. That is, the eccentric spray opening provided in the atomizing core cavity includes the eccentric spray opening which is concentric with its atomizing core cavity, the inclined spray opening which is not concentric with its atomizing core cavity, and the inclined spray opening formed by obliquely disposing the atomizing core in the atomizing core cavity seat. In addition, a filter may be provided in the spray head body with the spray core.

Embodiment 4

Figure 6:
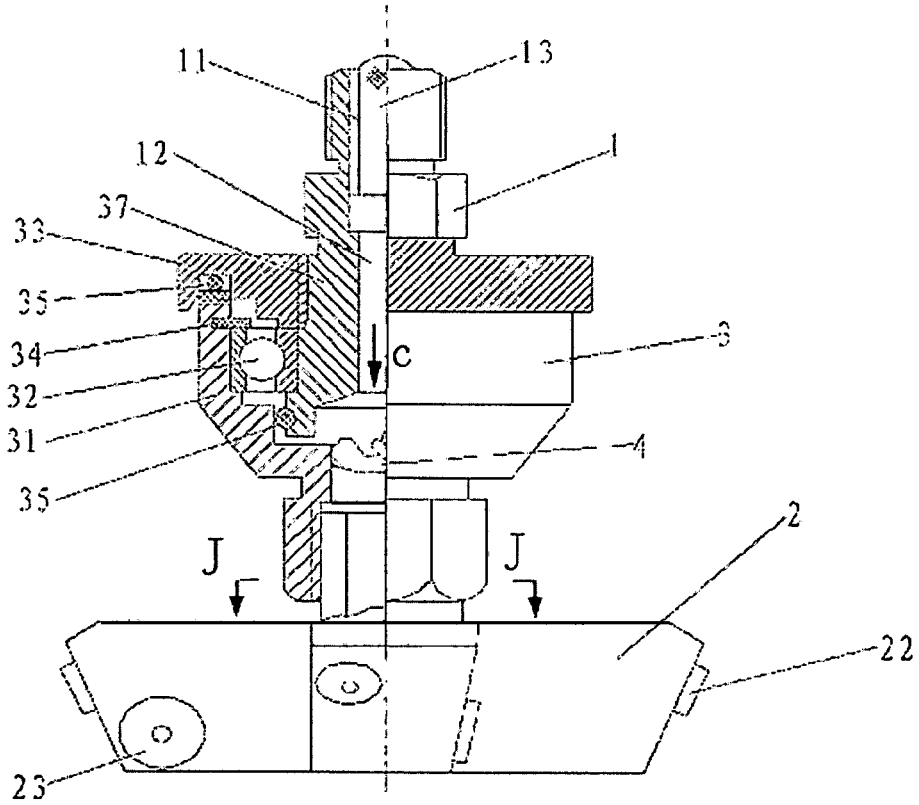
FIG. 6 is a schematic structural view of the rotary sprinkling device in embodiment 4 of the present invention, which is driven by combination of a reaction rotary drive mechanism and a jet push rotary drive mechanism.
Figures 1, 6:
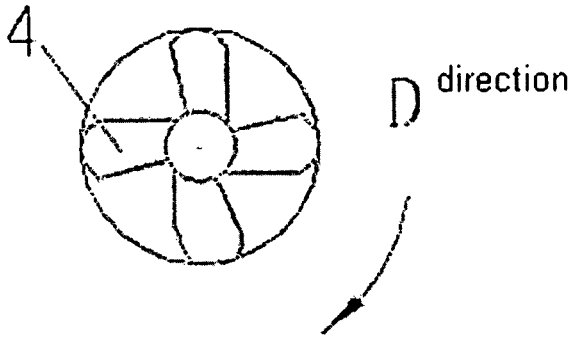
Figures 2, 6:
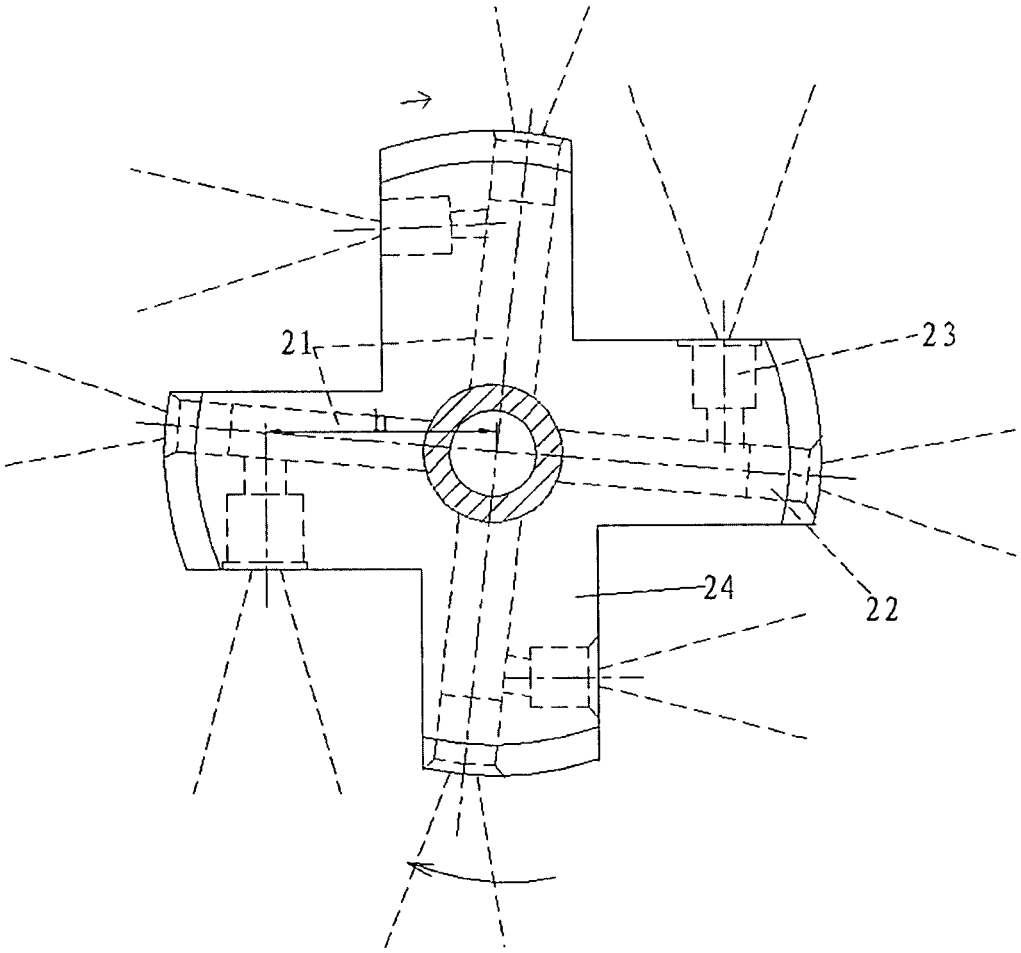

Referring to FIGS. 6, 6-1 and 6-2, a spray device driven under the combination of a reaction rotary mechanism and a jet push rotary mechanism according to the present invention is shown. The rotary spray device mainly includes a seat body 1 and a spray head body 2. The seat body 1 is hollow in structure to form a seat cavity. An end of the seat cavity is an entrance 11 connected with an outer input flow pipe (not shown in figures), and the other end is an outlet cavity 12. A filter 13 may be provided in the entrance 11.

The spray head body 2 is a rotation body, and a fluid passage 21 is provided in the spray head body 2. The entrance of the fluid passage 21 is rotatably connected to the seat body 1 by a connection component and communicates with the seat cavity, and the outlet of the fluid passage 21 is connected with a plurality of spray nozzles 22. The spray head body 2 and spray nozzles provided therein approximately form a rotation balance system.

The connection component may be a rotary connector 3. The rotary connector 3 includes an external connector 31, a bearing 32, a bearing cover 33, a spring clip 34 and a plurality of seals 35. The lower portion of the external connector 31 is connected with the spray head body 2. The outlet cavity wall 37 of the seat body 1 serving as an internal connector is inserted in the upper portion of the external connector 31. The bearing 32 is disposed between the outlet cavity wall 37 and the external connector 31. The spring clip 34 is fastened on the bearing 32 to fix the bearing 32. The external connector 31 is covered by the bearing cover 33. The seals 35 may be conventional O-shape ring, or may be a combination seal formed of an O-shape ring inside the groove and a low friction wear resistance plastic ring outside the groove. There may be thread connection between the external connector 31 and the spray head body 2, as well as between the outlet cavity wall 37 and the bearing cover 33, so as to allow a rapid rotation between the internal connector and the external connector 31 of the rotary connector 3 without leaking the internal pressurized fluid. It should be noted that, the internal and external connectors of the rotary connector are not defined by internal and external with respect to the space. Instead, the internal connector refers to the connector which is connected with the seat body 1 or directly replaces the seat body 1, and the external connector refers to the connector which is connected with the spray head body 2.

The self-driven rotary spray device is further provided with a drive mechanism which may generate a torque for rotating the spray head body 2 when it is pushed by fluid. The drive mechanism may be a strike driven impeller, and the driven impeller is disposed within the pressurized fluid cavity between the seat body 1 and the spray head body 2. The driven impeller is rotated with the spray head body 2 together, and the rotation direction thereof is identical with the tightened direction of the above connecting thread. As shown in FIG. 6-1, in the embodiment, the driven impeller is an axial flow type or semi-axial flow type paddle-shaped impeller 4 having inclined blades. The paddle-shaped impeller 4 is fixed in the external connector 31 of the rotary connector 3, and the number thereof may be 1 or 2. Each of paddle-shaped impellers 4 may have 3-6 paddle blades. Of cause, the paddle-shaped impeller 4 may also be fixed at the entrance of the spray head body 2. Alternatively, two impellers 4 may be provided at external connector 31 and the entrance of the spray head body 2, respectively. When axial or inclined axial water flow in the outlet cavity 12 of the seat body 1 impacts the paddle-shaped impeller 4, water flow applied force may generate rotation component torque on the paddle-shaped impeller 4 so as to rotate the paddle-shaped impeller 4, and then drive the spray head body 2 to rotate in D direction. Thus, the reaction rotary drive mechanism is formed.

The drive mechanism may also be at least two eccentric spray nozzles 23 provided in the spray head body 2. As shown in FIG. 6-2, the eccentric spray nozzles 23 are distributed in space rotary symmetry around the axis of the spray head body 2, and there is an eccentric distance h between the projection of the spray centerline of each eccentric spray nozzle 23 on the plane perpendicular to the axis of the spray head body and the axial center of the spray head body 2. When the eccentric spray nozzles 23 jet fluid, the reaction force from the fluid spray generates a torque to the spray head body 2, so that the spray head body 2 is rotated and the conventional non-torque spray nozzles 22 on the spray head body 2 is rotated with the eccentric spray nozzles 23, thereby forming the jet push rotary drive mechanism. The above eccentric spray nozzles 23 and the above paddle-shaped impellers 4 form the rotary drive mechanism driven under the combination of the reaction and the jet push. In the above drive mechanism, the spray direction of the eccentric spray nozzles is contrary to the rotation direction of the spray head body 2 driven by the impeller. Preferably, the rotation direction of the spray head body 2 is identical with the tighten direction of all connection thread.

Specifically, referring to FIG. 6-2 again, the spray head body 2 in the embodiment is a cross-shaped body 24 in which a cross-shaped fluid passage 21 is provided. Each cross arm of the spray head body 2 is provided with one eccentric spray nozzle 23 in the counter rotation direction, and each eccentric spray nozzle 23 angularly communicates with the fluid passage 21. In addition, a conventional non-torque spray nozzle 22 may be additionally provided at the outer end of each cross arm of the spray head body 2.

Embodiment 5

Figure 7:
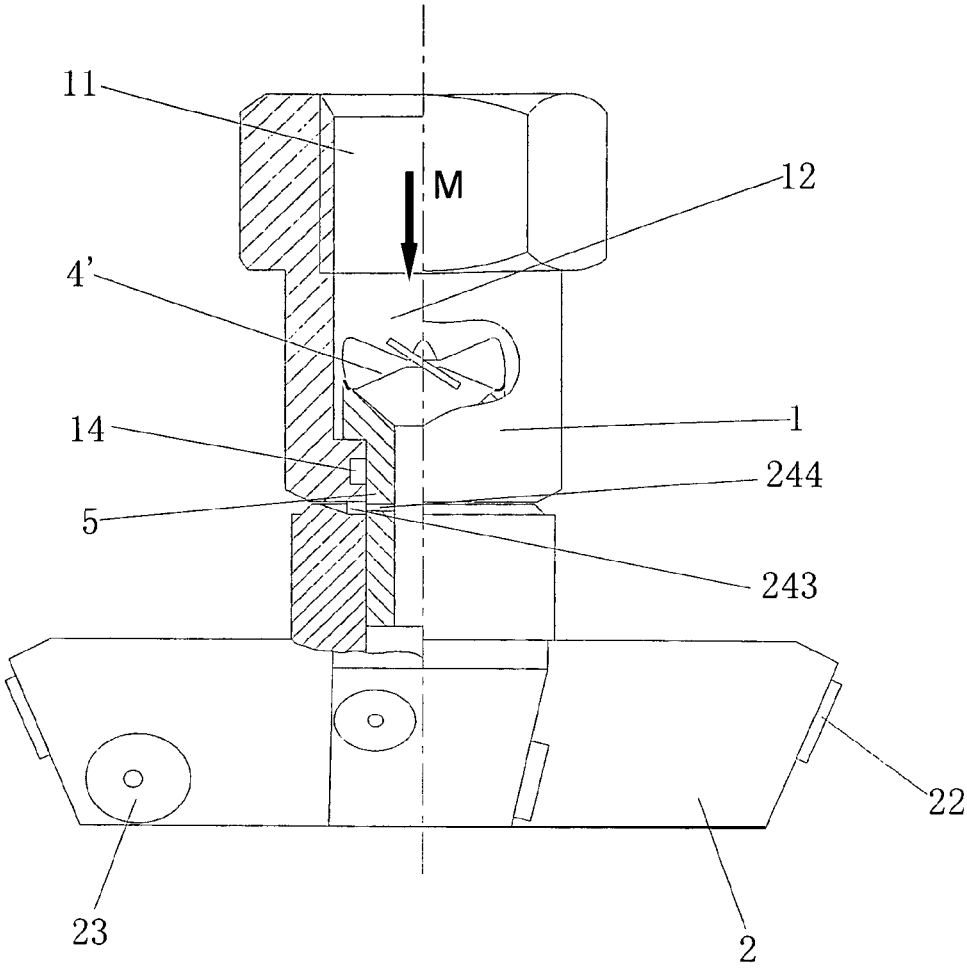
FIG. 7 is a schematic structural view of the rotary spray device in embodiment 5 of the present invention, which is driven by combination of reaction and jet push and has a sliding swivel bearing.
Figures 1, 7:
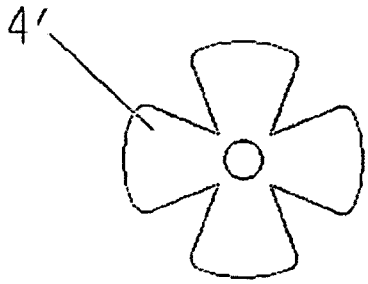

Referring to FIGS. 7 and 7-1, a spray device driven under the combination of reaction and jet push and having a sliding swivel bearing structure is shown. The self-driven rotary spray device in this embodiment also includes the seat body 1, the spray head body 2, a connection component and a drive mechanism.

The seat body 1 is hollow in its inside to form a seat cavity. The seat cavity has the entrance 11 and the outlet cavity 12.

The structure of the spray head body 2 is the same as that in above embodiment 1, i.e. the spray head body 2 provided with the cross-shaped body 24. Conventional non-torque spray nozzles 22 and eccentric spray nozzles 23 are provided in the spray head body 2. The eccentric spray nozzle 23 form the jet push rotary drive mechanism.

The drive mechanism further includes the paddle-shaped impeller with inclined blades.

The differences between the present embodiment and embodiment 4 lie in that: the paddle-shaped impeller in the present embodiment is a paddle-shaped impeller 4' with inclined sheet blades. The paddle-shaped impeller 4' with sheet blades is made by stamping sheet material and then folding blades into a certain angle, or may be a die cast. In addition, the connection component in the embodiment includes the entrance pipe 5, the bottom of which is connected with the spray head body 2 (in thread connection, the entrance pipe 5 herein has the substantially same functions as the entrance pipe in embodiment 1), and the top of which is fixed with the paddle-shaped impeller 4'. The entrance pipe 5 is received within the outlet cavity 12 at the lower portion of the seat body 1, so as to form a sliding swivel bearing connection. In order to reduce friction force of swiveling slide, a groove 14 may be provided between the entrance pipe 5 and the outlet cavity 12. A seal may be further provided at the groove 14. In addition, a fluid introducing hole 244 and a flow guiding groove 243 may be further provided. The engagement surface between the seat body 1 and the spray head body 2 may be designed as an annular spray opening. The working principle of the annular spray opening is the same as that in embodiment 1.

Embodiment 6

Figure 8:
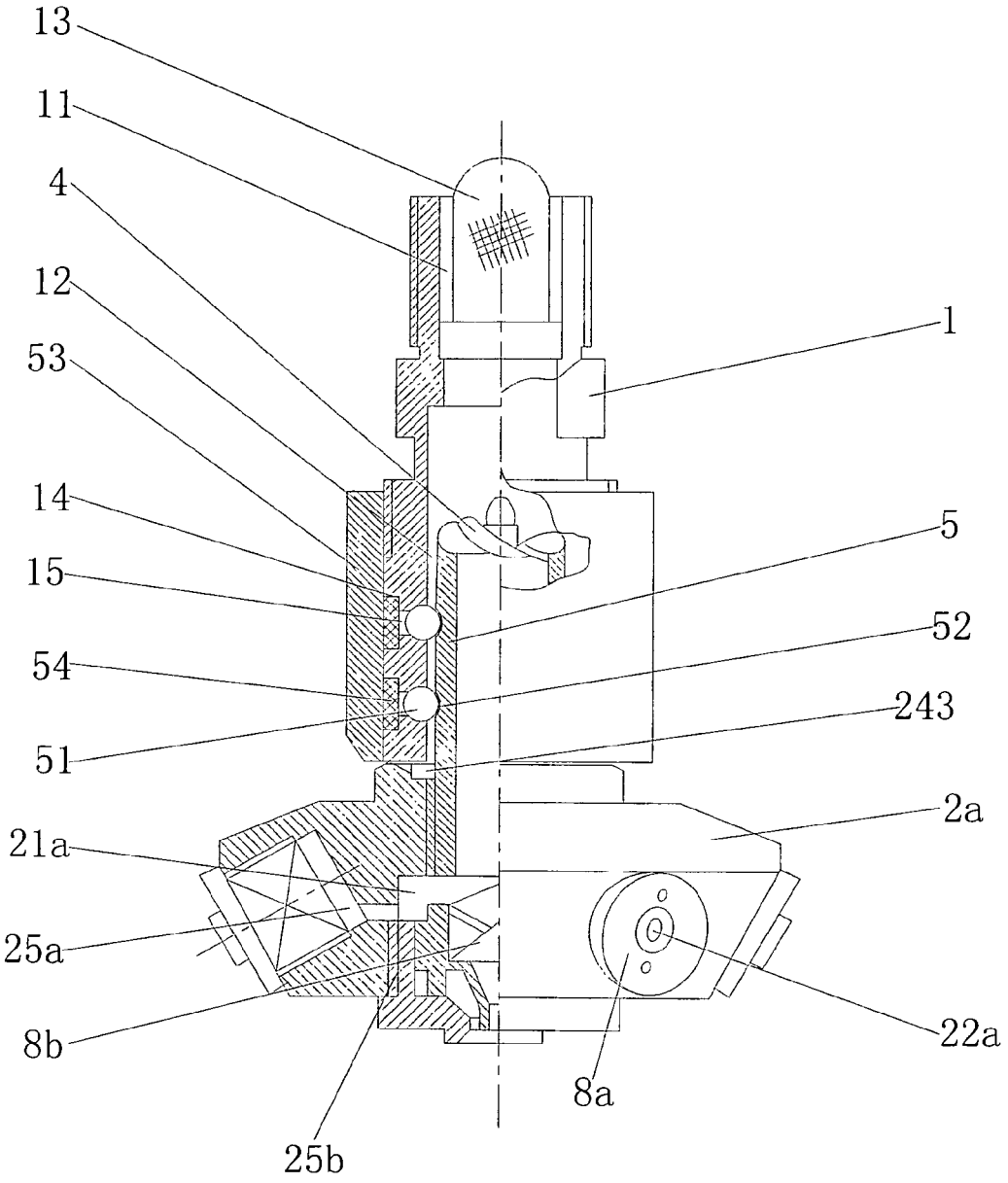
FIG. 8 is a schematic structural view of the spray device with the reaction rotary drive mechanism in embodiment 6 of the present invention.

Referring to FIG. 8, another structure of the spray device with the reaction rotary drive mechanism is shown. The spray device mainly includes the seat body 1 and the spray head body 2*a*.

A seat cavity is similarly provided within the seat body 1, and the entrance 11 and the outlet cavity 12 are provided in the seat body 1. The entrance 11 is provided with a filter 13.

The spray head body 2*a* may be a rotation body, in which is provided with a fluid passage 21*a*. The input end of the fluid passage 21*a* communicates with and is rotatably connected to the seat body 1 through a connection component. A plurality of spray nozzles 22*a* are provided at the periphery of the spray head body 2*a*.

The self-driving rotary spray device further includes a drive mechanism. The drive mechanism may be a paddle-shaped impeller 4, and the paddle-shaped impeller 4 is disposed in a pressure cavity between the seat body 1 and the spray head body 2*a* so as to form a reaction rotary drive mechanism.

The connection component in this embodiment mainly includes the entrance pipe 5 and a plurality of steel balls 51. The entrance pipe 5 may be threadedly connected with the upper portion of the spray head body 2*a*, or may be integrally formed with the spray head body 2*a*. The entrance pipe 5 is inserted in the outlet cavity 12 of the seat body 1. The paddle-shaped impeller 4 may be fixed at the top of the entrance pipe 5, or positioned on the entrance pipe 5 along circumference of the entrance pipe 5, so as to ensure that the paddle-shaped impeller 4 and the entrance pipe 5 are rotated together. One or two annular grooves 14 are provided on the outer wall of the outlet cavity 12 of the seat body 1. A plurality of through holes 15 with the same diameter are evenly provided in the groove 14. Steel balls 51 slightly smaller than the through holes 15 are provided in the through holes 15, and positioned in the arc annular groove 52 in the outer wall of the entrance pipe 5. An annular sleeve 53 is tightly fitted with two half annular bearing strip 54, which are disposed in the annular groove 14 and outside of the steel balls 51, and the outer wall of the outlet cavity 12; and there is a rotation clearance between the inner wall of the outlet cavity 12 and the outer wall of the entrance pipe 5.

A plurality of big through holes 25*a*, 25*b* is provided on the outer wall of the spray head body 2*a* in the embodiment. Atomizing core spray nozzles of various separated structure may be insertedly fixed or threadedly fixed in the big through holes 25*a*, 25*b*, so as to form spray nozzles 22*a* having special spray effects. For example, fine water mist atomizing core spray nozzles 8*a* may be insertedly fixed in the big through holes 25*a* located at the periphery of the spray head body 2*a* in the embodiment; and a rotational flow-vortical flow double spout atomizing core spray nozzle 8*b* may be insertedly fixed in the big through hole 25*b* at the bottom. Atomizing cores in other forms may be insertedly fixed in the big through holes 25*a*, 25*b*, such as foam atomizing core, mutual blow holes air-mist atomizing core. Besides, other kinds of spray nozzles may be insertedly fixed in the big through holes 25*a*, 25*b*, such as foam spray nozzle, water mist spray nozzle. Spray nozzles provided in the big through holes may be the jet push spray nozzles having an eccentric distance, so as to form the rotary spray device driven by the combination of the reaction and the jet push. Similarly, the flow guiding grooves may be further provided in the spray head body 2*a*, and the engagement surface between the spray head body 2*a* and the seat body 1 is designed as the annular spray opening.

Embodiment 7

Figure 9:
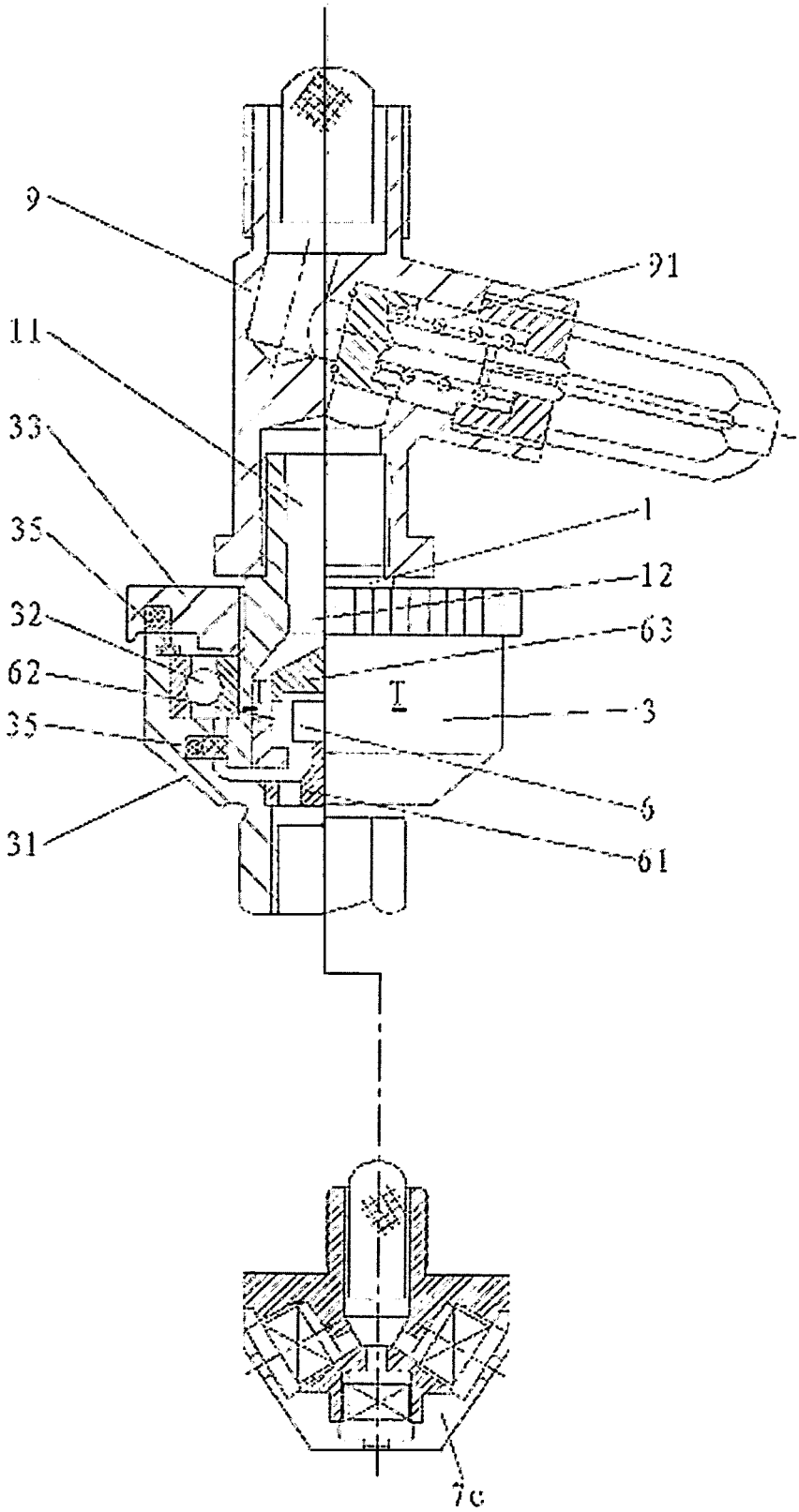
FIG. 9 is a schematic structural view of the spray device in embodiment 7 of the present invention, in which the impact rotary drive mechanism is provided with many kinds of spray heads.
Figures 1, 9:
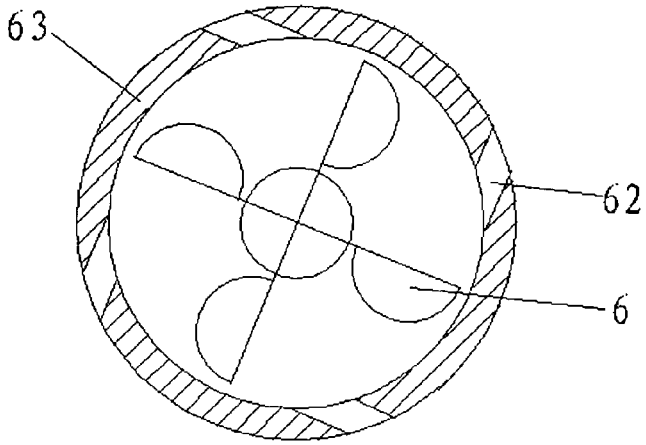
Figures 2, 9:
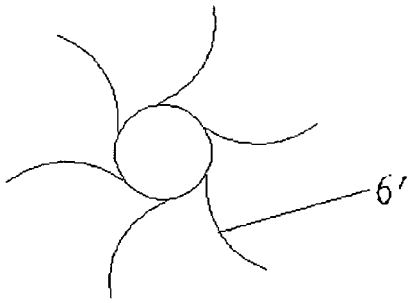
Figures 3, 9:
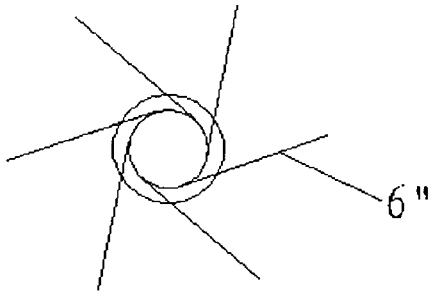

Referring to schematic structural views in FIGS. 9, 9-1, 9-2 and 9-3, a structure of a spray device according to the present invention, in which an impact rotary drive mechanism may be provided and which may be used with many kinds of spray heads is shown. The self-driving rotary spray device mainly includes the seat body 1, a spray head body, a connection component and a drive mechanism. The seat body 1 is also provided with the entrance 11 and the outlet cavity 12. The entrance 11 is connected to a water supply pipe via a normally closed valve 9 having a three-way pipe. One filter 13 is provided at the entrance of the upper portion of the three-way pipe, and one heat sensitive mechanism 91 is provided at the side opening of the three-way pipe. The outlet of the normally closed valve 9 is connected to the connection component via the lower portion of the seat body 1. The connection component is a rotary connector 3 (the structure thereof is the same as that in embodiment 4, and thus its description is omitted). The lower portion of the external connector 31 of the rotary connector 3 is connected with the spray head body. A driven impeller is provided within the pressure cavity of the external connector 31 between the seat body 1 and the spray head body. The impeller may be the impeller 6 (as shown in FIG. 9-1) having funnel-shaped blades which receives the impact of rotational flow, or may be the impeller 6' (as shown in FIG. 9-2) having arc-shaped sheet blades, or may be the impeller 6" (as shown in FIG. 9-3) having flat sheet blades. The impeller 6 is fixed within the external connector 31 by an impeller supporter 61. Corresponding to the blades, a plurality of rotational flow spray openings 62 are fixed within the cavity of the seat body 1 outside the impeller 6 or within the pressure cavity of the external connector 31. The rotational flow spray opening 62 may be disposed in a fix seat 63. When the impeller 6 is subject to the impact force of rotational flow from the rotational flow spray opening 62, the external connector 31 and the spray head body are driven to rotate together, so as to form an impact rotary drive mechanism. Preferably, the rotation direction of the spray head body is identical with the tightening direction of connection thread.

In this embodiment, the spray head which is threadedly connected with the lower portion of the external connector 31 of the rotary connector 3 may be any kind of spray head such as fine water mist spray head 7*c*, so as to form various particular closed type rotary spray device. Examples include closed type foam or foam mist rotary spray head, closed type fine water mist or air-water-mist rotary spray head, closed type water mist rotary spray head, closed type oil mist rotary spray head. If the normally closed valve 9 at the entrance of the rotary connector 3 in the embodiment is removed, the above closed type rotary spray devices become corresponding opened type rotary spray device; e.g. sprinkling spray devices such as opened type foam or foam mist rotary spray device, opened type fine water mist or air-water-mist rotary spray device, opened type water mist or big water drop sprinkling rotary spray device, opened type oil mist rotary spray head. The spray head body and the spray nozzles provided in the spray head body are substantially a rotation balance system.

Embodiment 8

Figure 10:
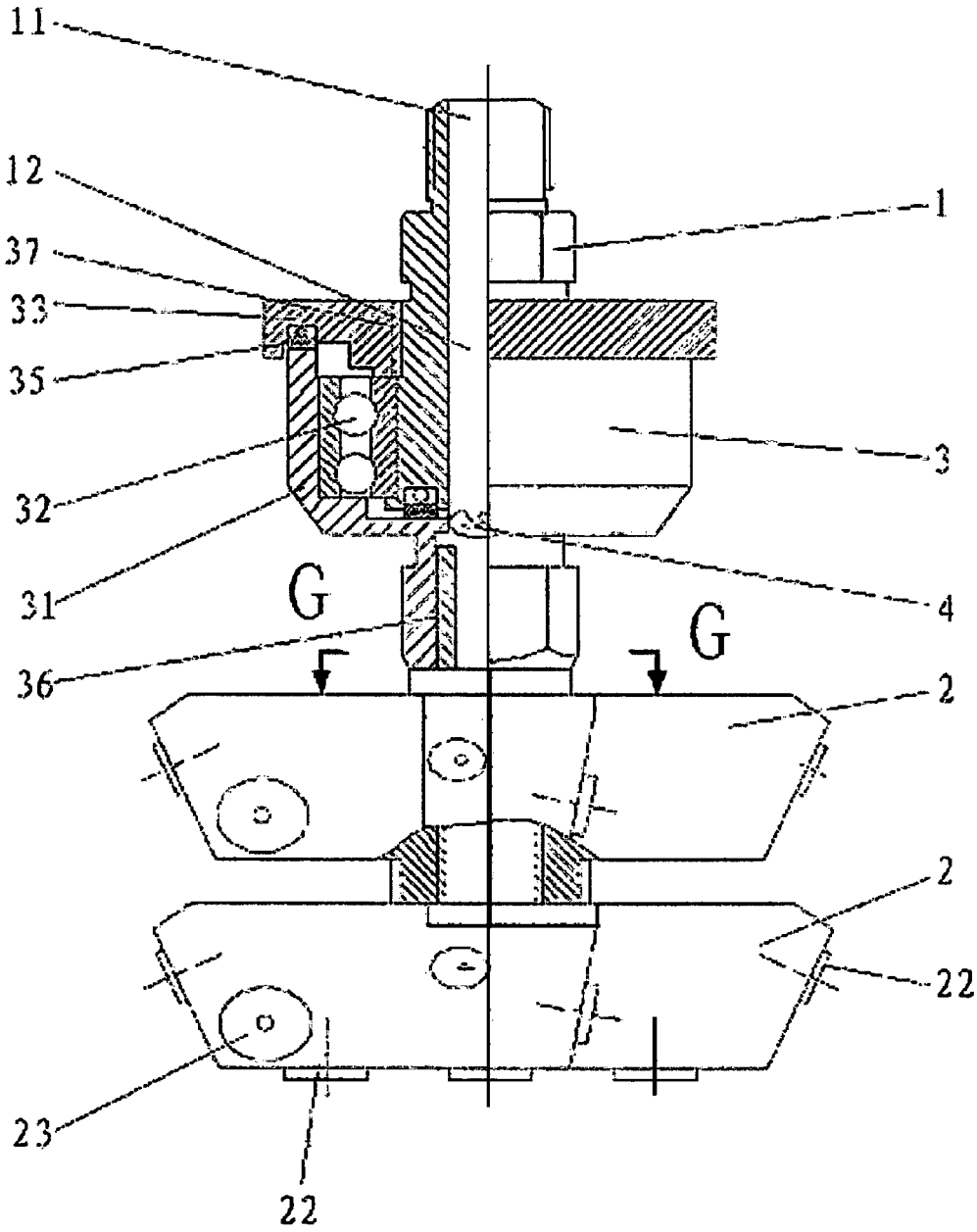
FIG. 10 is a schematic view of the spray device in embodiment 8 of the present invention, which is driven by combination action of impact and jet push and has stacked spray head body.
Figures 1, 10:
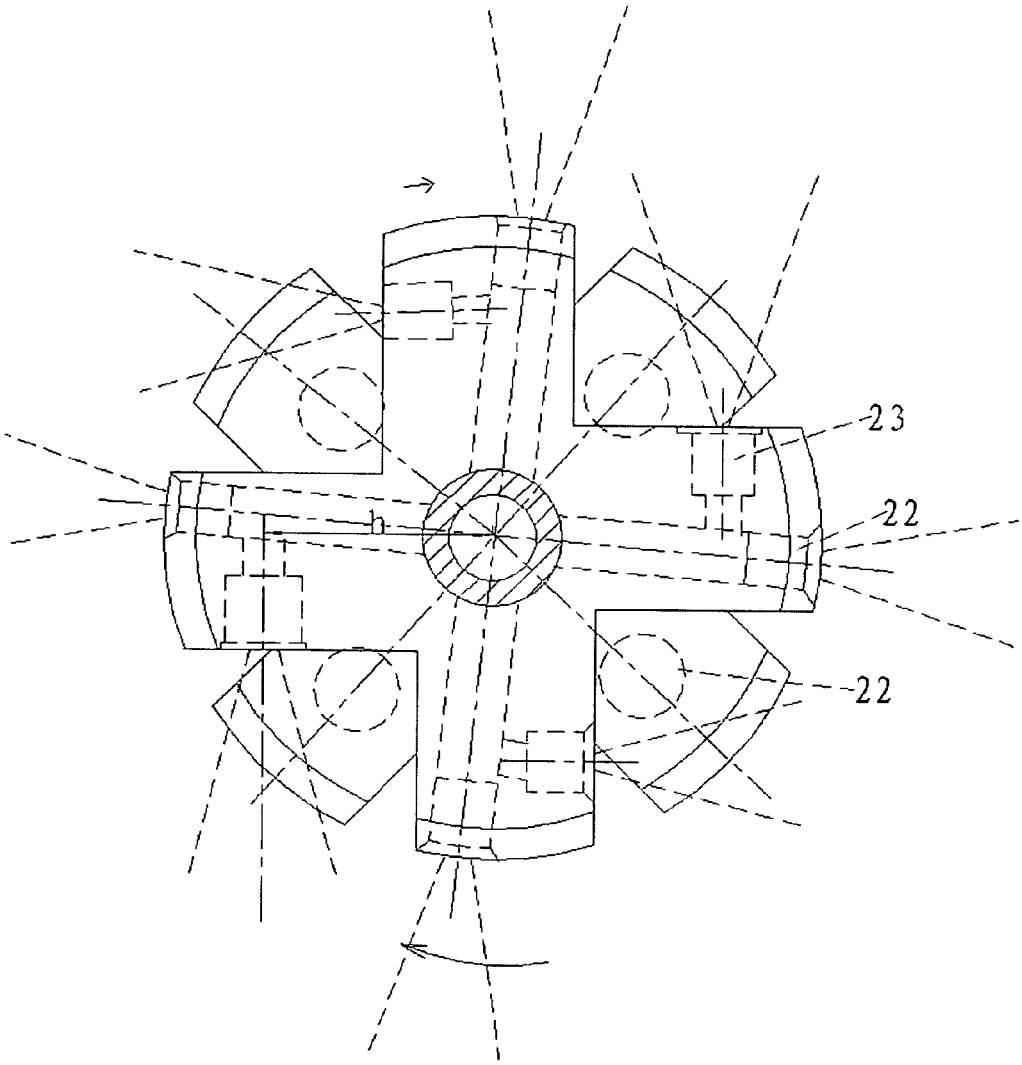

Referring to FIGS. 10 and 10-1, a rotary spray device of the present invention which is driven under combination action of impact and jet push and stacked with a plurality of spray head bodies are illustrated. The present embodiment is generally same as the embodiment 4 mentioned above, and thus the same part is not described repeatedly. However, the embodiment has the following differences: two layers of the spray head bodies 2 of cross-shaped body are vertically stacked below the rotary connector 3 of above embodiment 4, and the cross-shaped bodies of two layers of the spray head body 2 are arranged in stagger manner (as shown in FIG. 10-1), so as to form a spray device having a combination driving structure of impact and multi-layer jet push. The above two layers of spray head bodies 2 may be threadedly connected together and positioned with pin. A plurality of non-torque spray nozzles 22 may be provided on the bottom surface of the lower layer of the spray head body 2. The lower layer of the spray head body 2 of the embodiment may be a spray head body having various special spray effects.

The bearing in the rotary connector 3 in the embodiment is a double row ball bearing.

Embodiment 9

Figure 11:
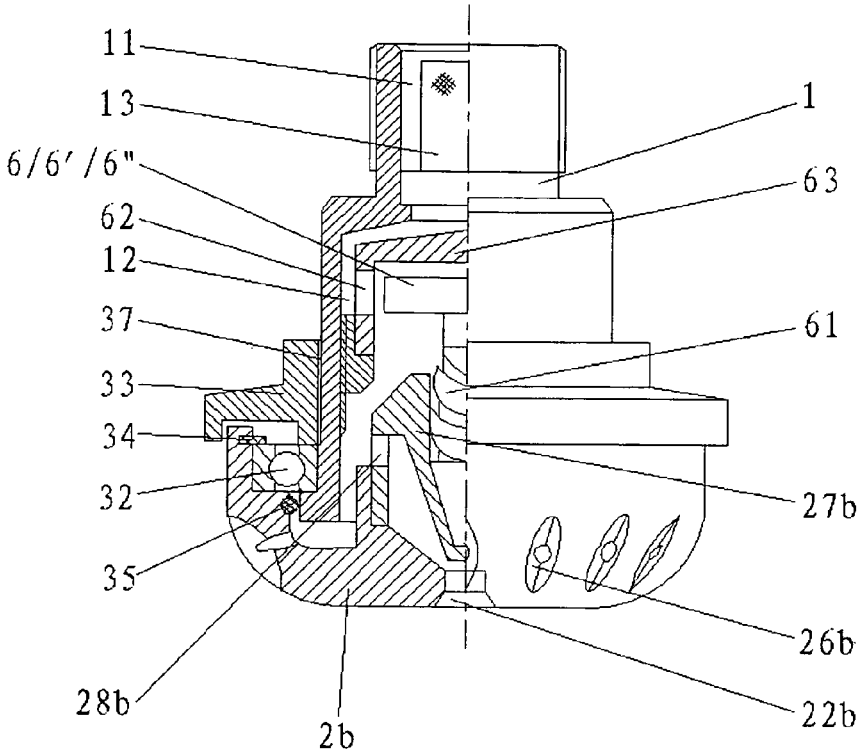
FIG. 11 is a schematic structural view of a further spray device with the impact rotary drive mechanism in embodiment 9 of the present invention.

Referring to FIG. 11 of the drawings, a schematic structural view of another spray device with an impact rotary drive mechanism according to the present invention is shown. The self-driving rotary spray device in the embodiment similarly includes the seat body 1, the spray head body 2*b*, the connection component and the drive mechanism.

The seat body 1 is similarly provided with the entrance 11 and the outlet cavity 12. One filter 13 is provided in the entrance 11.

The spray head body 2*b* is a rotation body. A plurality of eye-like aperture spray nozzles 26*b* are provided at the periphery of the spray head body 2*b*. For the eye-like aperture spray nozzle 26*b*, large inclined aperture enlarged outwardly is provided at the periphery of the small spray aperture, so water forms into thin film in the rapid enlarged large inclined aperture after being ejected from the small spray aperture. Afterwards, fine water mist is sprayed out.

The connection component includes a bearing 32, a bearing cover 33, a spring clip 34 and a seal 35. The bearing 32 is directly disposed between the spray head body 2*b* and the outer wall of the outlet cavity 12 of the seat body 1. The bearing cover 33 provided on the seat body 1 may accommodate the bearing 32 and cover the spray head body 2*b*.

The drive mechanism may be the impeller 6, 6', 6" having funnel-shaped blades or sheet blades and fixed within the spray head body 2*b* by an impeller supporter 61 and a rotational flow seat 27*b*. A fix seat 63 is provided at the periphery of the impeller 6, 6', 6", and provided with a plurality of rotational flow spray openings 62 corresponding to the impeller. The rotation torque generated from the impeller forms the impact rotary drive mechanism in the embodiment.

In addition, an inclined groove or rotational flow groove is provided on the impeller supporter 61. The rotational flow seat 27*b* is provided with a rotational flow groove 28*b* in the outer side wall thereof, and conical spray orifices in the inner side wall thereof. The rotational flow seat 27*b* is fixed on the spray head body 2*b*. The spray head body 2*b* is provided with a spray nozzle 22*b* at the center of the bottom thereof, so as to form an atomizing core structure having a double rotational flow parallel spray nozzle. It should be appreciated that, the spray device according to the embodiment may be connected to the outlet of the normally closed valve 9 in embodiment 7 to form a normally closed spray device; or may be connected to the spray head threadedly connected with the lower portion of the external connector 31 in embodiment 7 to form multi-stage rotary spray device.

It should be noted that, in the present invention, the impeller used in the reaction drive mechanism and the impeller used in the impact drive mechanism are collectively referred to as driven impeller.

Various atomizing core spray nozzles which can spray fine mist may be provided on the spray head body 2, 2*a* or the fine water mist spray head 7*c* of the rotary spray device in the above embodiments of the present invention, and thus the "self-driving fine mist rotary spray device" is formed. If water is supplied, the "self-driving fine water mist rotary spray device" is formed.

For example, the rotational flow-vortex flow double opening atomizing core spray nozzle 8*b* in FIG. 8, the spray nozzle 22*b* at the center of the bottom of the spray head body 2*b* as well as the structure above the spray nozzle 22*b* in FIG. 11, and the eye-like aperture spray nozzles 26*b* in FIG. 11, are the atomizing core spray nozzles.

The above atomizing core spray nozzles may be eccentrically disposed to form the atomizing core spray nozzles having an eccentric distance. The fine mist spray device is driven under the combination of the spray torque generated from the spray nozzles and the torque generated from the reaction impeller to form a rotational spray.

The spray head body of the above self-driving rotary fine mist spray device may be provided with the fine mist atomizing core spray nozzles having different structure. As an embodiment, two kinds of the fine atomizing core spray nozzles are emphatically described as follows.

1) The double rotational flow atomizing core spray nozzle includes the parallel spray nozzle and serial spray nozzle. The serial spray nozzle is described as an embodiment below.

Figure 12:
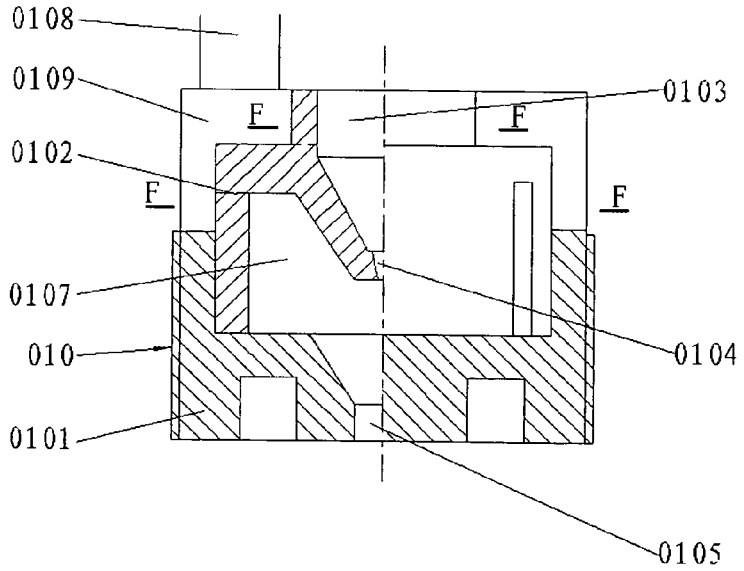
FIG. 12 shows an atomizing core of a double rotational flow serial spray nozzle according to the present invention.
Figures 1, 12:
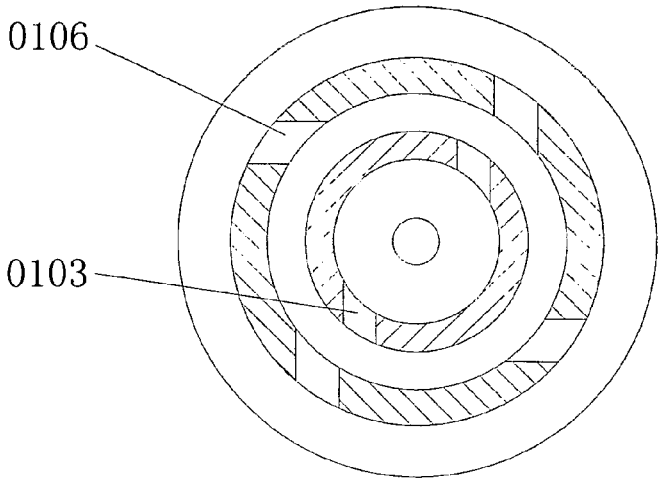
Figures 2, 12:
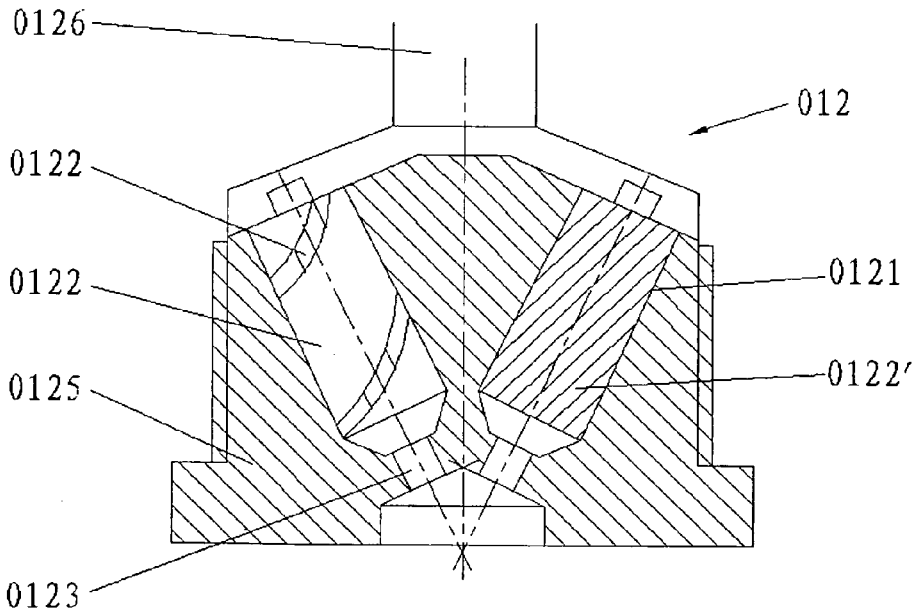

Schematic structural views of a double rotational flow serial atomizing core spray nozzle 010 are shown in FIGS. 12 and 12-1.

A double rotational flow sleeve 0102 is tightly fitted within an inner cavity hole 0107 of a core seat 0101 of the atomizing core spray nozzle 010. 3 to 6 rotational flow grooves 0106 are provided in a larger diameter annular wall of the double rotational flow sleeve 0102, and 2 to 4 rotational flow grooves 0103 are provided in a smaller diameter annular wall of the double rotational flow sleeve 0102. The end surface of the small diameter annular wall of the double rotational flow sleeve 0102 is enclosed by the bottom surface of the cavity of the spray head. An input hole 0108 of the cavity of the spray head is provided at a side surface of a bottom of an atomizing core cavity 0109, and communicates with the outer opening of the rotational flow grooves 0106, 0103. The atomizing core seat 0101 and double rotational flow sleeve 0102 respectively have shrinkage spray orifices 0105 and 0104, which are in series along the same axis. The atomizing core seat 0101 is threadedly connected within the cavity of the big through hole of the spray head body according to the present invention, or connected with a through hole of another spray head, to form serial spray nozzle of the double rotational flow atomizing core. In the embodiment of the atomizing core spray nozzle, if the above-mentioned two shrinkage spray orifices 0105 and 0104 are disposed close with each other, so that the small spray orifice 0104 is concentrically located inside the large spray orifice 0105, the parallel spray nozzle of the double rotational flow atomizing core is formed.

2) A schematic structural view of a rotor atomizing core of a spray nozzle with a striking hole is shown in FIG. 12-2.

The atomizing core spray nozzle is provided with an atomizing core seat 0125 in which 3 to 6 inclined holes 0121 are disposed evenly. Axes of small outlet spray orifices 0123 of the respective holes 0121 are symmetry and intersect. One rotatable shaft 0124 having 1 to 3 spiral flow guiding grooves 0122 or a plurality of inclined narrow grooves 0122' is provided in each hole 0121. An input hole 0126 of a cavity of the spray head communicates with holes 0121. Water flows from spiral flow guiding groove 0122 or 0122' into holes 0121 to rotate the shafts 0124, so as to form thin water film. A plurality of water films are secondly atomized after being sprayed and struck, so that a rotational flow rotor striking hole atomizing core is formed.

Embodiment 10

Figure 13:
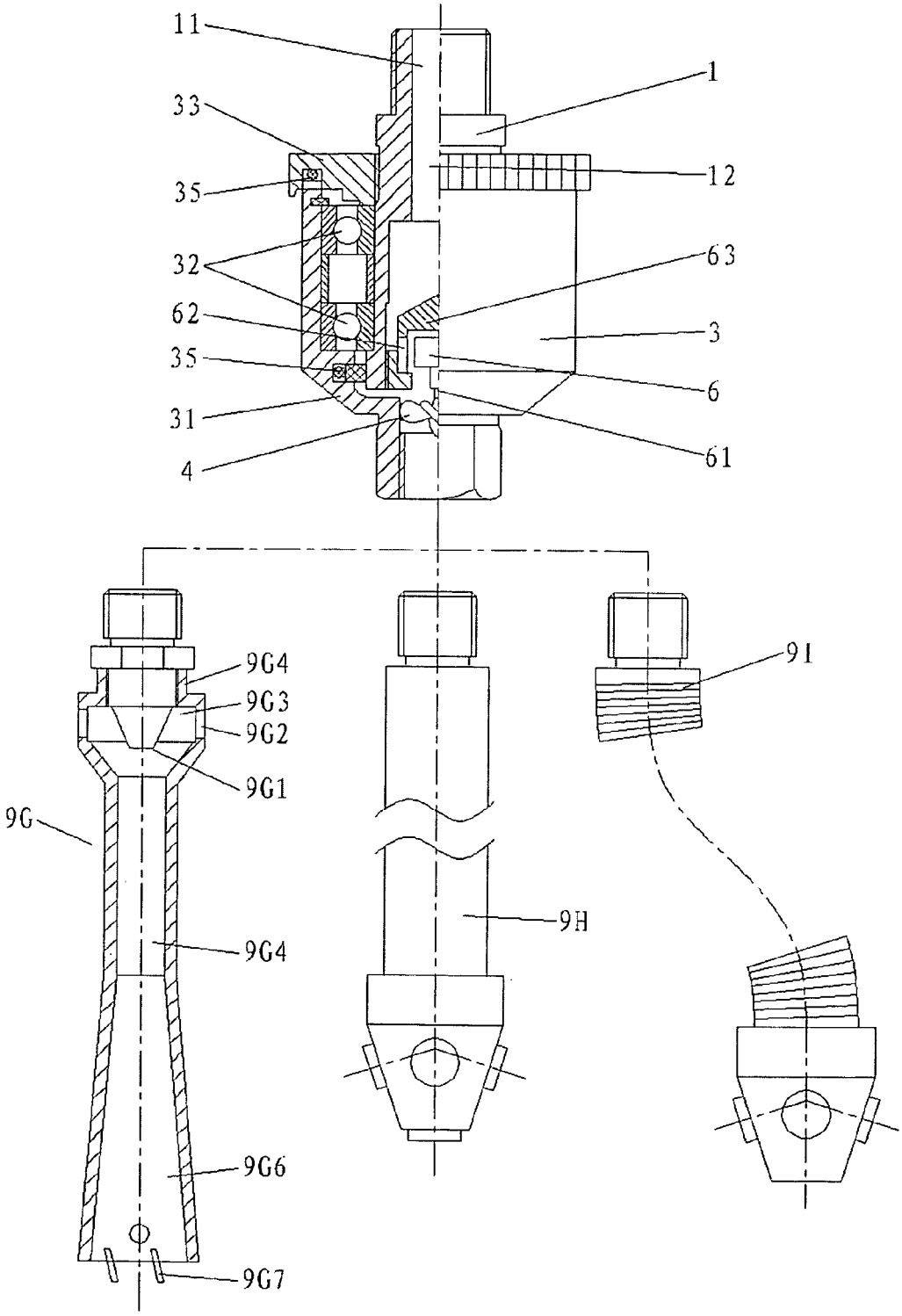
FIG. 13 is a schematic structural view of a long pipe spray gun or sprayer in embodiment 10 of the present invention, which is rotated by combination of impact and reaction.

Referring to FIG. 13, a long pipe spray gun-like spray device according to the present invention which is rotated under the combination of impact and reaction is shown. The spray device in the embodiment is similar to that in embodiment 7 shown in FIG. 9. Thus, the parts indicated by the same reference numerals in FIGS. 13 and 9 are not described repeatedly. The differences in the embodiment lie in that: first, in this embodiment, the normally closed valve 9 in FIG. 9 is removed. Second, in this embodiment, three kinds of long pipe-shaped spray guns, i.e. liquid-gas ejector type venturi atomization spray gun 9G, long hard tube spray gun 9H, long hose spray gun 9I, may be used, instead of various spray heads 7*c* in FIG. 9. Third, in this embodiment, two rolling bearings 32 are used. Fourth, the rotary drive mechanism in the embodiment employs both the impact impeller 6 shown in FIG. 9 and the reaction paddle-shaped impeller 4 in FIG. 6, which may improve the rotation force by the combination drive of two rotation drive mechanisms. The impeller used in the reaction drive mechanism and the impeller used in the impact drive mechanism in the present invention are collectively referred to as driven impeller.

The input fluid of the rotary spray device of the embodiment may be water, oil or other liquids, or may be the gas-liquid two-phase fluid or multiphase fluid.

The spray head body of the embodiment actually may be the liquid-gas ejector type venturi atomization spray gun 9G, the long hard tube spray gun 9H or the long hose spray gun 9I, the spray nozzle engaged with them may be selected depending on spray medium and spray fineness degree. The long hose spray gun 9I is only applied to some special cases where the spray gun needs to be bended to be placed into. The liquid-gas ejector type venturi atomization spray gun 9G may be used to combustion spray, and includes an atomization spray nozzle g1, air suction holes g2, an air introduction chamber g3, an air mixing sleeve g4, a throat pipe g5 and a diffuser spray pipe g6. Diffuser blades g7 and the like may be additionally provided at the outlet of the diffuser spray pipe g6. The atomization spray nozzle g1 may also be the multi-hole spray nozzle shown in FIG. 12-2.

If a fine spray is required, the filter may be provided at the entrance 11 in the embodiment.

The self-driving rotary spray device according to the present invention may be used to fir extinguishing or other sprays, and may be used individually or in group. The individual use is referred to that one self-driving rotary spray device is served as a single fire extinguishing spray head or spray gun. The group use is referred to that a plurality of self-driving rotary spray devices are installed at terminals of pipelines of fire extinguishing system such as automatic sprinkling system, water spray system, fine water mist system, foam spray system and serve as opened type or closed type rotary spray head. The self-driving rotary spray devices may be also installed at terminals of pipelines of spray dust removal, spray drying, spray irrigation and so on as, and serve as group spray. One skilled in the art will understand that the embodiment of the present invention as shown in the drawings and described above is exemplary only and not intended to be limiting. It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A rotary spray device comprising a seat body, a spray head body and an impeller, wherein said spray head body is rotatably connected with said seat body, wherein said seat body has an inner hole, an entrance communicating with an external pressurized flow source, a fluid passage, and a plurality of spray openings, and a plurality of atomizing cores provided on said spray head body, wherein said spray openings are arranged to communicate with said fluid passage, wherein at least two of said spray openings are eccentric spray openings to define an eccentric distance between a projection of a centerline of said eccentric spray openings on a plane perpendicular to an axis of said spray head body, said spray device further comprises an impeller rotating together with said spray head body, in which a rotational direction of said impeller is identical to a tightening direction of a connection thread on said spray head body of said spray device, wherein said impeller is located between said inner hole of said seat body and said fluid passage, wherein an open direction of said eccentric spray openings is opposite to a rotation direction of said spray head body pushed by said impeller.

2. The rotary spray device, as recited in claim 1, further comprising a plurality of rotation engagement surfaces provided on said spray head body, wherein each of said rotation engagement surfaces has at least one liquid leaking clearance designed as an annular spray opening.

3. The rotary spray device, as recited in claim 1, wherein a shape of said spray head body is of a truncated polyhedral cone, wherein said eccentric spray openings of said spray head body are inclinedly formed thereon, wherein each of said inclined eccentric spray openings has an atomizing core cavity, wherein a centerline of said atomizing core cavity obliquely intersects with a centerline of said corresponding inclined eccentric spray opening.

4. The rotary spray device, as recited in claim 1, wherein each of said eccentric spray openings has an atomizing core cavity provided therein, wherein each of said atomizing cores comprises at least one of a swirl core, a swirl mutual colliding flow core, a vortex flow sheet core and a double rotational flow core, wherein said spray opening is for a rotational flow cavity, and is embodied as one of a single-hole spray opening and a concentric double spray opening, wherein each of said eccentric spray openings are integrally inclined spray openings concentric with said atomizing core cavities respectively, and an inclined spray opening whose centerline obliquely intersects with said centerline of said atomizing core cavity communicating therewith.

5. The rotary spray device, as recited in claim 1, wherein said impeller is of an annular shape, and has a plurality of paddles arranged to receive a fluid pushing force and generate a rotation torque, wherein said impeller is fixed at said input end of said spray head body for driving said spray head body to rotate.

6. The rotary spray device, as recited in claim 1, further comprising a plurality of rotation engagement surfaces provided on said spray head body, wherein each of said rotation engagement surfaces has at least one liquid leaking clearance designed as an annular spray opening, wherein at least one rotation engagement surface is designed as an annular spray opening for spraying leak liquid through said rotation clearance, wherein said annular spray opening has an larger entrance than a spray opening, an annular groove is provided at said inner side of said annular spray opening, and said annular groove communicates with said fluid passage through a fluid introducing hole.

7. The rotary spray device, as recited in claim 6, wherein said spray head body has an entrance pipe rotatably connected in said inner hole of said seat body, wherein said impeller is fixed to an inlet end of said entrance pipe, wherein an annular surface clearance communicating with said inner hole of said seat body is formed between a circular step of said spray head body exposed outside said inner hole of said seat body and a lower annular surface of said seat body, wherein said annular surface clearance is designed as said annular spray opening, wherein each of said annular surfaces has a plurality of radial narrow ditches provided thereon, wherein each of said radial narrow ditches has an entrance section and an outlet section, wherein said entrance section is larger than said outlet section.

8. The rotary spray device, as recited in claim 7, wherein said seat body further comprises a plurality of steel balls, has two annular grooves provided on an outer wall of said seat body, and a plurality of through holes evenly provided in said annular grooves, wherein a rotatable connection between said entrance pipe and said inner hole of said seat body is a rotation connection through said steel balls and said annular grooves, wherein a diameter of each of said steel balls is slightly smaller than that of said corresponding through hole, wherein said seat body further comprises an annular sleeve and two half annular bearing strips, wherein said annular sleeve is provided on an outer side of said seat body and is tightly fitted with said half annular bearing strips which are disposed in said annular groove, wherein said bearing strips block said steel balls in said through holes, and there exists a rotation clearance between said inner hole of said seat body and said outer wall of said entrance pipe.

9. The rotary spray device, as recited claim 1, wherein said sear body further has a hollow shaft having a plurality of inclined through holes, in which said spray head body is rotatably installed on said hollow shaft to form an annular cavity between said spray head body and said hollow shaft, wherein said inclined through holes communicates with said fluid passage in said spry head body through said annular cavity; wherein said eccentric spray openings are provided at said periphery of said spray head body and communicate with said atomizing core cavity, wherein a projection portion is formed on said atomizing core is provided on an inner circumference wall of said annular cavity of said atomizing core cavity, wherein said spray head body annular cavity has an atomizing core cavity projection portion forming said impeller;

wherein said rotary spray device further comprises a heat sensitive support component, wherein a shrinkage hole is provided at said entrance of said central through hole of said hollow shaft, wherein said shrinkage hole is blocked by a piston member to block said communication between said entrance of said seat body and said inclined through holes, wherein said piston member abuts against said heat sensitive support component, wherein a base end plug of said heat sensitive support component is fixed to said other end of said through hole of said hollow shaft;

wherein a circular step surface of said seat body is engaged with a lower annular flat surface of said spray head body to form said rotation engagement surface, which forms an annular surface clearance, wherein said annular surface clearance is designed as said annular spray opening for spraying leak liquid through said clearance.

10. The rotary spray device, as recited in claim 1, wherein said rotatable connection between said spray head body and said seat body is a rotation connection with a connection component, which comprises a rotation connector comprising an internal connector, an external connector and a rolling bearing located between said inner connector and said external connector, wherein said spray head body and said seat body are fixedly connected with said external connector and said internal connector respectively, wherein said connection component further comprises an external connector and a rolling bearing located between said seat body and said external connector, wherein said spray head body is fixed with said external connector, said impeller is fixed with said external connector or said spray head body;

wherein said connection component further comprises a rolling bearing located between said seat body and said spray head body, said impeller is fixed with said spray head body.

11. The rotary spray device, as recited in claim 1, wherein a shape of said spray head body is a space generatrix revolving solid, wherein said eccentric spray opening of said spray head body is a spray opening having eccentric wedge groove and eye-like apertures; wherein said seat body has a fluid cavity having a fixed seat provided therein, wherein said seat body further has a rotational flow spray opening which is arranged to face said impeller and is provided on a cavity wall of said fix seat, wherein said impeller is fixed to an impeller supporter fixedly connected with said spray head body.

12. The rotary spray device, as recited in claim 1, wherein said rotary spray device further comprises a spray gun communicating with said fluid passage, said spray gun comprises one of a hard tube spray gun, a long hose spray gun, and a liquid-gas ejector type venturi atomization spray gun, wherein said liquid-gas ejector type venturi atomization spray gun comprises an atomization spray nozzle, an air introducing chamber with an air suction hole, a throat pipe and a diffuser spray pipe.

13. The rotary spray device, as recited in claim 1, wherein said seat body comprises a normally closed valve, wherein said spray head body comprises a spray head.

* * * * *